US010474069B2

(12) United States Patent
Sato et al.

(10) Patent No.: US 10,474,069 B2
(45) Date of Patent: Nov. 12, 2019

(54) IMAGE FORMING APPARATUS CAPABLE OF RESTRAINING OCCURRENCE OF ELECTRIC DISCHARGE BETWEEN INTERMEDIATE TRANSFER BELT AND SHEET

(71) Applicant: Brother Kogyo Kabushiki Kaisha, Nagoya-shi, Aichi-ken (JP)

(72) Inventors: Shougo Sato, Seto (JP); Atsushi Miwa, Aki (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 16/440,129

(22) Filed: Jun. 13, 2019

(65) Prior Publication Data

US 2019/0294082 A1 Sep. 26, 2019

Related U.S. Application Data

(63) Continuation of application No. 15/998,524, filed on Aug. 16, 2018.

(30) Foreign Application Priority Data

Aug. 25, 2017 (JP) ..... 2017-161911

(51) Int. Cl.
*G03G 15/16* (2006.01)
*G03G 21/16* (2006.01)

(52) U.S. Cl.
CPC ..... *G03G 15/1615* (2013.01); *G03G 21/168* (2013.01); *G03G 2215/1623* (2013.01)

(58) Field of Classification Search
CPC ..... G03G 15/1615; G03G 21/1638; G03G 21/168; G03G 2215/1623;
(Continued)

(56) References Cited

U.S. PATENT DOCUMENTS 8,112,014 B2 2/2012 Kawanami
8,543,023 B2 9/2013 Hosohara et al.
(Continued)

FOREIGN PATENT DOCUMENTS

JP 2002-091189 A 3/2002
JP 2004-126166 A 4/2004
(Continued)

*Primary Examiner* — Sophia S Chen
(74) *Attorney, Agent, or Firm* — Banner & Witcoff, Ltd.

(57) ABSTRACT

An image forming apparatus includes: a drum unit including a photosensitive drum; a belt unit; and a secondary transfer member. The belt unit includes: a first roller; a second roller spaced apart from the first roller; an intermediate transfer belt supported by the first roller and the second roller; and a primary transfer member. The intermediate transfer belt includes: a first portion; and a second portion. The first portion has an upstream end and a downstream end in a first direction. The second portion has an upstream end and a downstream end in a second direction. The primary transfer member is configured to transfer a toner image from the photosensitive drum to the first portion. The secondary transfer member is capable of contacting the downstream end of the second portion, and is configured to transfer the toner image from the intermediate transfer belt to a sheet.

10 Claims, 17 Drawing Sheets

(58) Field of Classification Search
CPC ... G03G 2215/0193; G03G 2221/1642; G03G 2221/1675
See application file for complete search history.

(56) References Cited

U.S. PATENT DOCUMENTS

| | | | | |
|---|---|---|---|---|
| 9,104,170 | B2 | 8/2015 | Shikata et al. | |
| 10,185,253 | B2 * | 1/2019 | Sato | G03G 15/1605 |
| 2003/0147678 | A1 | 8/2003 | Ozawa et al. | |
| 2008/0028967 | A1 | 2/2008 | Sakashita et al. | |
| 2011/0293316 | A1 | 12/2011 | Sato | |
| 2013/0251396 | A1 | 9/2013 | Shikata et al. | |
| 2014/0270841 | A1 | 9/2014 | Sato | |
| 2016/0154344 | A1 | 6/2016 | Sato | |
| 2017/0255134 | A1 | 9/2017 | Sato | |
| 2018/0107153 | A1 * | 4/2018 | Sato | G03G 15/0879 |

FOREIGN PATENT DOCUMENTS

| | | | |
|---|---|---|---|
| JP | 2011-248137 | A | 12/2011 |
| JP | 2013-195933 | A | 9/2013 |

* cited by examiner

IMAGE FORMING APPARATUS CAPABLE OF RESTRAINING OCCURRENCE OF ELECTRIC DISCHARGE BETWEEN INTERMEDIATE TRANSFER BELT AND SHEET

CROSS REFERENCE TO RELATED APPLICATION

This application is a continuation of U.S. patent application Ser. No. 15/998,524 filed Aug. 16, 2018 which claims priority from Japanese Patent Application No. 2017-161911 filed Aug. 25, 2017. The entire contents of the priority applications are incorporated herein by reference.

TECHNICAL FIELD

The present disclosure relates to an image forming apparatus.

BACKGROUND

Conventionally, there has been known an image forming apparatus including a photosensitive drum, an intermediate transfer belt to which a toner image formed on the photosensitive drum is transferred, and a secondary transfer roller for transferring the toner image on the intermediate transfer belt to a sheet (see Japanese Patent Application Publication No. 2004-126166).

The intermediate transfer belt is supported by a first roller, a second roller spaced apart from the first roller, and a third roller. The intermediate transfer belt includes a first portion and a second portion. The first portion is in contact with the photosensitive drum. When the intermediate transfer belt is moved, the first portion is moved from the first roller toward the second roller, and the second portion is moved from the second roller toward the first roller. The second portion is bending at a position between the first roller and the second roller since the second portion is in contact with the third roller at the position between the first roller and the second roller.

The secondary transfer roller is disposed at a position between the first roller and the second roller, and is positioned opposite to the third roller with respect to the second portion. The secondary transfer roller is in contact with the second portion so as to nip the second portion in cooperation with the third roller.

SUMMARY

In the image forming apparatus disclosed in the Japanese Patent Application Publication No. 2004-126166, the intermediate transfer belt is bending at a nipped position between the secondary transfer roller and the third roller.

A sheet conveyed in the image forming apparatus is spaced apart from the intermediate transfer belt before the sheet reaches the nipped position. Then, the sheet is brought into contact with the intermediate transfer belt when the sheet is conveyed to the nipped position.

With the configuration described above, before the sheet reaches the nipped position, electric discharge caused by transfer current may occur between the sheet and the intermediate transfer belt.

In this case, charge polarity of toner on the intermediate transfer belt may be varied due to the electric discharge before the sheet reaches the nipped position. This may cause amount of toner that is not transferred onto the sheet to be increased.

In view of the foregoing, it is an object of the present disclosure to provide an image forming apparatus capable of restraining occurrence of electric discharge between a sheet and an intermediate transfer belt caused by transfer current, and reliably transferring a toner image onto the sheet.

In order to attain the above and other objects, according to one aspect, the disclosure provides an image forming apparatus including: a drum unit; a belt unit; and a secondary transfer member. The drum unit includes a photosensitive drum. The belt unit includes: a first roller; a second roller; an intermediate transfer belt; and a primary transfer member. The second roller is spaced apart from the first roller. The intermediate transfer belt is supported by the first roller and the second roller. The intermediate transfer belt includes: a first portion; and a second portion. The first portion is positioned between the first roller and the second roller. The first portion is configured to be moved in a first direction directed from the first roller to the second roller when the intermediate transfer belt is circularly moved over the first roller and the second roller. The first portion has an upstream end and a downstream end in the first direction. The upstream end of the first portion is in contact with the first roller. The downstream end of the first portion is in contact with the second roller. The second portion is positioned between the first roller and the second roller. The second portion is configured to be moved in a second direction directed from the second roller to the first roller when the intermediate transfer belt is circularly moved over the first roller and the second roller. The second portion has an upstream end and a downstream end in the second direction. The upstream end of the second portion is in contact with the second roller. The downstream end of the second portion is in contact with the first roller. The primary transfer member is positioned between the first roller and the second roller. The primary transfer member is configured to transfer a toner image from the photosensitive drum to the first portion. The secondary transfer member is capable of contacting the downstream end of the second portion. The secondary transfer member is configured to transfer the toner image from the intermediate transfer belt to a sheet.

According to another aspect, the disclosure provides an image forming apparatus including: a main casing; a drum unit; a belt unit; and a secondary transfer unit. The drum unit is attachable to and detachable from the main casing. The drum unit includes a photosensitive drum. The belt unit is attachable to and detachable from the main casing. The belt unit includes: a first roller; a second roller; an intermediate transfer belt; a primary transfer member; and a first sheet guide. The second roller is spaced apart from the first roller. The intermediate transfer belt is supported by the first roller and the second roller. The intermediate transfer belt includes: a first portion; a second portion; a third portion; and a fourth portion. The first portion is positioned between the first roller and the second roller. The first portion is configured to be moved in a first direction directed from the first roller to the second roller when the intermediate transfer belt is circularly moved over the first roller and the second roller. The first portion has an upstream end and a downstream end in the first direction. The upstream end of the first portion is in contact with the first roller. The downstream end of the first portion is in contact with the second roller. The second portion is positioned between the first roller and the second roller. The second portion is configured to be moved in a second direction directed from the second roller to the first roller when the intermediate transfer belt is circularly moved over the first roller and the second roller. The second portion has an upstream end and a downstream end in the second direction. The upstream end of the second portion is in contact with the second roller. The downstream end of the second portion is in contact with the first roller. The third portion is positioned between the first portion and the second portion. The first roller has an outer circumferential surface exclusively in contact with the third portion. The third portion is configured to be moved along the outer circumferential surface of the first roller from the downstream end of the second portion toward the upstream end of the first portion when the intermediate transfer belt is circularly moved over the first roller and the second roller. The fourth portion is positioned between the first portion and the second portion. The second roller has an outer circumferential surface exclusively in contact with the fourth portion. The fourth portion is configured to be moved along the outer circumferential surface of the second roller from the downstream end of the first portion toward the upstream end of the second portion when the intermediate transfer belt is circularly moved over the first roller and the second roller. The primary transfer member is positioned between the first roller and the second roller. The primary transfer member is configured to transfer a toner image from the photosensitive drum to the first portion. The first sheet guide is positioned opposite to the first portion with respect to the second portion. The first sheet guide is configured to guide a conveyance of a sheet in a sheet conveying direction toward a prescribed position on the second portion of the intermediate transfer belt. The prescribed position is positioned upstream of the downstream end of the second portion in the second direction. The prescribed position is positioned closer to the downstream end of the second portion in the second direction than to the upstream end of the second portion in the second direction. The secondary transfer unit is attachable to and detachable from the main casing. The secondary transfer unit includes: a second sheet guide; and a secondary transfer member. The second sheet guide is configured to guide the conveyance of the sheet in the sheet conveying direction toward the prescribed position on the second portion of the intermediate transfer belt in cooperation with the first sheet guide. The secondary transfer member is capable of contacting the intermediate transfer belt at a position closer to the downstream end of the second portion than to the upstream end of the first portion so that the intermediate transfer belt is nipped between the secondary transfer member and the first roller. The secondary transfer member is configured to transfer the toner image from the intermediate transfer belt to the sheet guided toward the prescribed position by the first sheet guide and the second sheet guide.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

1. Outline of Image Forming Apparatus 1

An image forming apparatus 1 according to a first embodiment of the present disclosure will be described with reference to FIGS. 1 through 9B.

Figure 1:
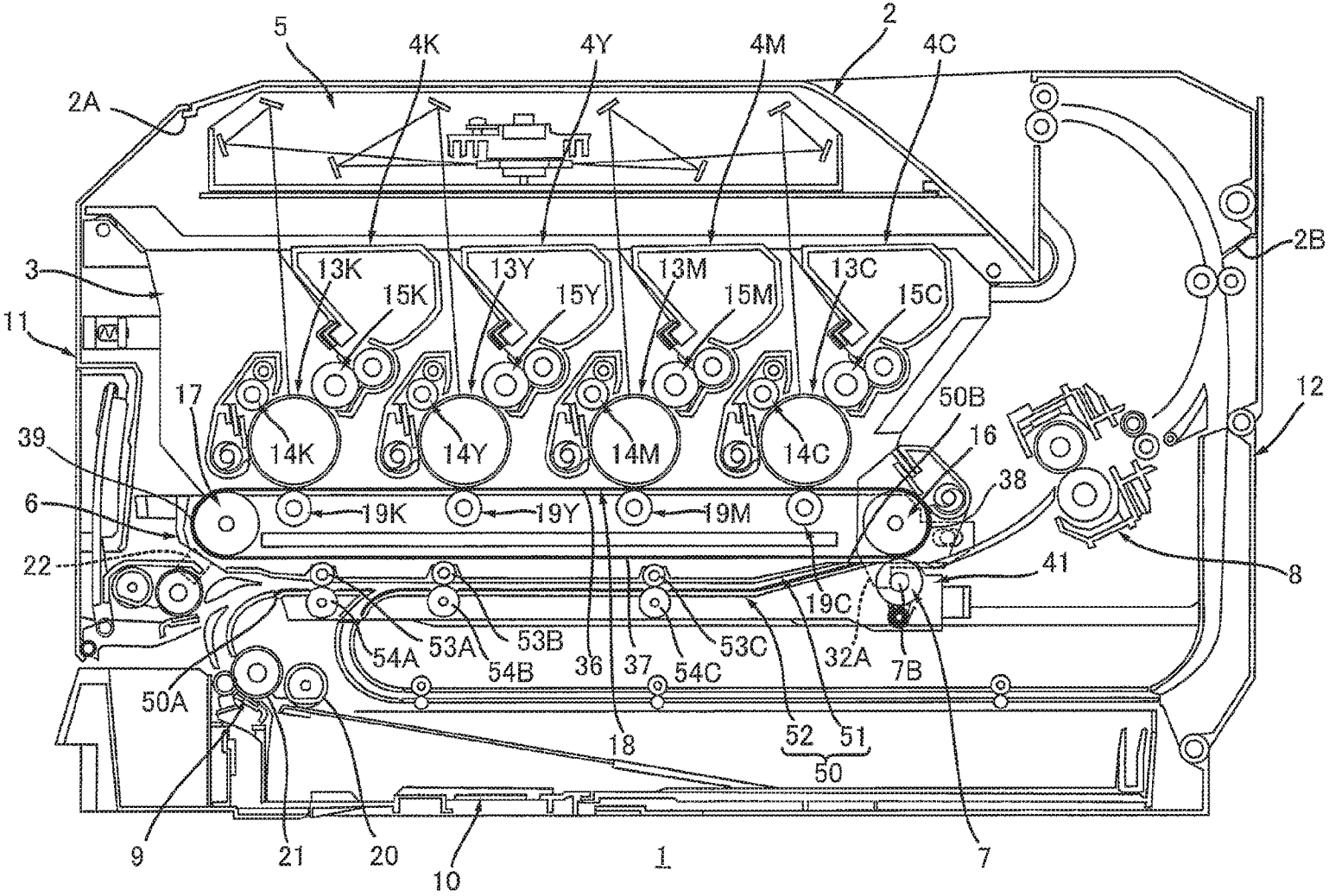
FIG. 1 is a schematic diagram illustrating a configuration of an image forming apparatus according to a first embodiment of the present disclosure.

As illustrated in FIG. 1, the image forming apparatus 1 includes a main casing 2, a drum unit 3, a plurality of developing cartridges 4K, 4Y, 4M, and 4C, an exposure unit 5, a belt unit 6, a sensor 22, a secondary transfer roller 7, a fixing unit 8, a sheet supply unit 9, and a sheet supply tray 10.

<1.1 Main Casing 2>

The main casing 2 constitutes an outer shell of the image forming apparatus 1, and accommodates therein the drum unit 3, the plurality of developing cartridges 4K, 4Y, 4M, and 4C, the exposure unit 5, the belt unit 6, the sensor 22, the secondary transfer roller 7, the fixing unit 8, the sheet supply unit 9, and the sheet supply tray 10. The main casing 2 is formed with a first opening 2A (see FIG. 2) and a second opening 2B (see FIG. 4). The second opening 2B is positioned opposite to the first opening 2A with respect to an intermediate transfer belt 18 (described later) of the belt unit 6. Further, the main casing 2 includes a first cover 11 and a second cover 12.

The first cover 11 is movable between an open position (see FIG. 2) opening the first opening 2A and a closing position (see FIG. 1) closing the first opening 2A.

The second cover 12 is movable between an open position (see FIG. 4) opening the second opening 2B and a closing position (see FIG. 1) closing the second opening 2B.

<1.2 Drum Unit 3>

The drum unit 3 is movable through the first opening 2A between a first position (see FIG. 1) in which the drum unit 3 is positioned inside the main casing 2 and a second position (see FIG. 2) in which the drum unit 3 is positioned outside the main casing 2. The drum unit 3 includes a plurality of photosensitive drums 13K, 13Y, 13M, and 13C, and a plurality of charging rollers 14K, 14Y, 14M, and 14C.

The plurality of photosensitive drums 13K, 13Y, 13M, and 13C are arrayed with an interval between neighboring photosensitive drums in a direction in which a first roller 16 and a second roller 17 are arrayed. The first roller 16 and the second roller 17 will be described later. Since configurations of the photosensitive drums 13K, 13Y, 13M, and 13C are identical to each other, the configuration of the photosensitive drum 13K will be described, while description of the remaining photosensitive drums 13Y, 13M, and 13C are omitted. The photosensitive drum 13K is rotatable about a rotational axis extending in an axial direction.

Further, the charging rollers 14K, 14Y, 14M, 14C have configurations identical to each other. Therefore, the configuration of the charging roller 14K will be described while omitting description of the remaining charging rollers 14Y, 14M, and 14C. The charging roller 14K is configured to charge an outer circumferential surface of the photosensitive drum 13K, and is in contact with the outer circumferential surface of the photosensitive drum 13K.

<1.3 Developing Cartridges 4K, 4Y, 4M, and 4C>

Each of the plurality of developing cartridges 4K, 4Y, 4M, and 4C is attachable to the drum unit 3. Configurations of the developing cartridges 4K, 4Y, 4M, and 4C are identical to each other, and therefore, the configuration of the developing cartridge 4K will be described while omitting description of the remaining developing cartridges 4Y, 4M, and 4C. The developing cartridge 4K is capable of accommodating toner therein, and configured to supply the toner to the photosensitive drum 13K. The developing cartridge 4K includes a developing roller 15K. Similarly, the developing cartridges 4Y, 4M, and 4C include the developing rollers 15Y, 15M, and 15C, respectively.

The developing roller 15K is configured to supply the toner accommodated in the developing cartridge 4K to the photosensitive drum 13K. The developing roller 15K is in contact with the outer circumferential surface of the photosensitive drum 13K when the developing cartridge 4K is attached to the drum unit 3.

<1.4 Exposure Unit 5>

The exposure unit 5 is configured to expose the plurality of photosensitive drums 13K, 13Y, 13M, and 13C to light. More specifically, the exposure unit 5 is a laser scan unit.

<1.5 Belt Unit 6>

The belt unit 6 includes the first roller 16, the second roller 17, the intermediate transfer belt 18, and a plurality of primary transfer rollers 19K, 19Y, 19M, and 19C. The plurality of primary transfer rollers 19K, 19Y, 19M, and 19C is an example of a primary transfer member. Instead of the transfer roller, a transfer blade and a transfer pad are available as the primary transfer member.

The first roller 16 is a tension roller. Although the detailed configuration will be described later, the first roller 16 is movable in a direction toward the second roller 17 and in a direction away from the second roller 17, and is urged in the direction away from the second roller 17. Therefore, the first roller 16 imparts a tensile force on the intermediate transfer belt 18 directed in the direction away from the second roller 17. The first roller 16 is rotatable about a rotational axis extending in the axial direction.

The second roller 17 is spaced apart from the first roller 16. In the following description, the direction in which the first roller 16 and the second roller 17 are arrayed will be referred to as "array direction". The array direction crosses the axial direction. Preferably, the array direction is perpendicular to the axial direction. The second roller 17 is positioned opposite to the fixing unit 8 with respect to the first roller 16. The second roller 17 is a drive roller rotatable about a rotational axis extending in the axial direction.

The intermediate transfer belt 18 is an endless belt supported by and the first roller 16 and the second roller 17. The intermediate transfer belt 18 is mounted over the first roller 16 and the second roller 17, and is circularly movable over the first roller 16 and the second roller 17. Incidentally, the intermediate transfer belt 18 is configured to expand and contract due to, for example, change in temperature. Assuming that a position of the first roller 16 relative to the second roller 17 is fixed, it is presumable that the intermediate transfer belt 18 is excessively slackened or strained when the intermediate transfer belt 18 is expanded or contracted. However, in the present embodiment, the first roller 16 is movable in the direction toward the second roller 17 and in the direction away from the second roller 17, and is urged in the direction away from the second roller 17. Accordingly, a tensile force can be appropriately applied to the intermediate transfer belt 18.

The primary transfer rollers 19K, 19Y, 19M, and 19C are positioned between the first roller 16 and the second roller 17, and are arrayed in the array direction. Since configurations of the primary transfer rollers 19K, 19Y, 19M, and 19C are identical to each other, only the configuration of the primary transfer roller 19K will be described, while description of the remaining primary transfer rollers 19Y, 19M, and 19C is omitted. The primary transfer roller 19K is configured to transfer a toner image from the photosensitive drum 13K to a first portion 36 (described later) of the intermediate transfer belt 18. The primary transfer roller 19K is positioned opposite to the photosensitive drum 13K with respect to the first portion 36.

<1.6 Sensor 22>

The sensor 22 is configured to detect the toner image primarily transferred from the photosensitive drums 13K, 13Y, 13M, and 13C to the intermediate transfer belt 18 and to output predetermined signals. The image forming apparatus 1 includes a controller (not illustrated) configured to receive the signals outputted from the sensor 22 and to determine whether color deviation, density deviation, and the like occur in the primarily transferred toner image. The sensor 22 faces an outer surface of the intermediate transfer belt 18 that is a surface onto which the toner image is primarily transferred. The sensor 22 is positioned adjacent to the second roller 17, and is positioned downstream of the photosensitive drum 13K in a direction in which the intermediate transfer belt 18 is moved (hereinafter "moving direction of the intermediate transfer belt 18"). Further, the sensor 22 is positioned upstream of a first guide member 51 (described later) in the moving direction of the intermediate transfer belt 18. Further, the sensor 22 is positioned downward relative to a diametrical center of the second roller 17. With this arrangement, the sensor 22 does not prevent attachment and detachment of the belt unit 6 to and from the main casing 2 of the image forming apparatus 1.

<1.7 Secondary Transfer Roller 7>

The secondary transfer roller 7 is configured to transfer the toner image that has been transferred to the intermediate transfer belt 18 onto a sheet S. The secondary transfer roller 7 is an example of a secondary transfer member. Instead of the transfer roller, a transfer blade and a transfer pad may be used as the secondary transfer member. The secondary transfer roller 7 is provided at a secondary transfer unit 41 (described later).

<1.8 Fixing Unit 8>

The fixing unit 8 is configured to heat and press the sheet S onto which the toner image has been transferred to thereby fix the toner image to the sheet S. The sheet S moved past the fixing unit 8 is discharged onto an upper surface of the main casing 2.

<1.9 Sheet Supply Unit 9>

The sheet supply unit 9 includes a pick-up roller 20 and a sheet supply roller 21. The pick-up roller 20 is configured to convey the sheet S accommodated in the sheet supply tray 10 toward the sheet supply roller 21. The sheet supply roller 21 is configured to supply the sheet S conveyed by the pick-up roller 20 toward a first conveying roller 53A. Then, the sheet S is conveyed toward the secondary transfer roller 7 by a plurality of first conveying rollers 53A, 53B, and 53C and a plurality of second conveying rollers 54A, 54B, and 54C. The plurality of first conveying rollers 53A, 53B, and 53C, and the plurality of second conveying rollers 54A, 54B, and 54C will be described later in detail.

<1.10 Sheet Supply Tray 10>

The sheet supply tray 10 is configured to accommodate therein the sheets S.

2. Details of Belt Unit 6

Next, a configuration of the belt unit 6 will be described in detail.

Figure 2:
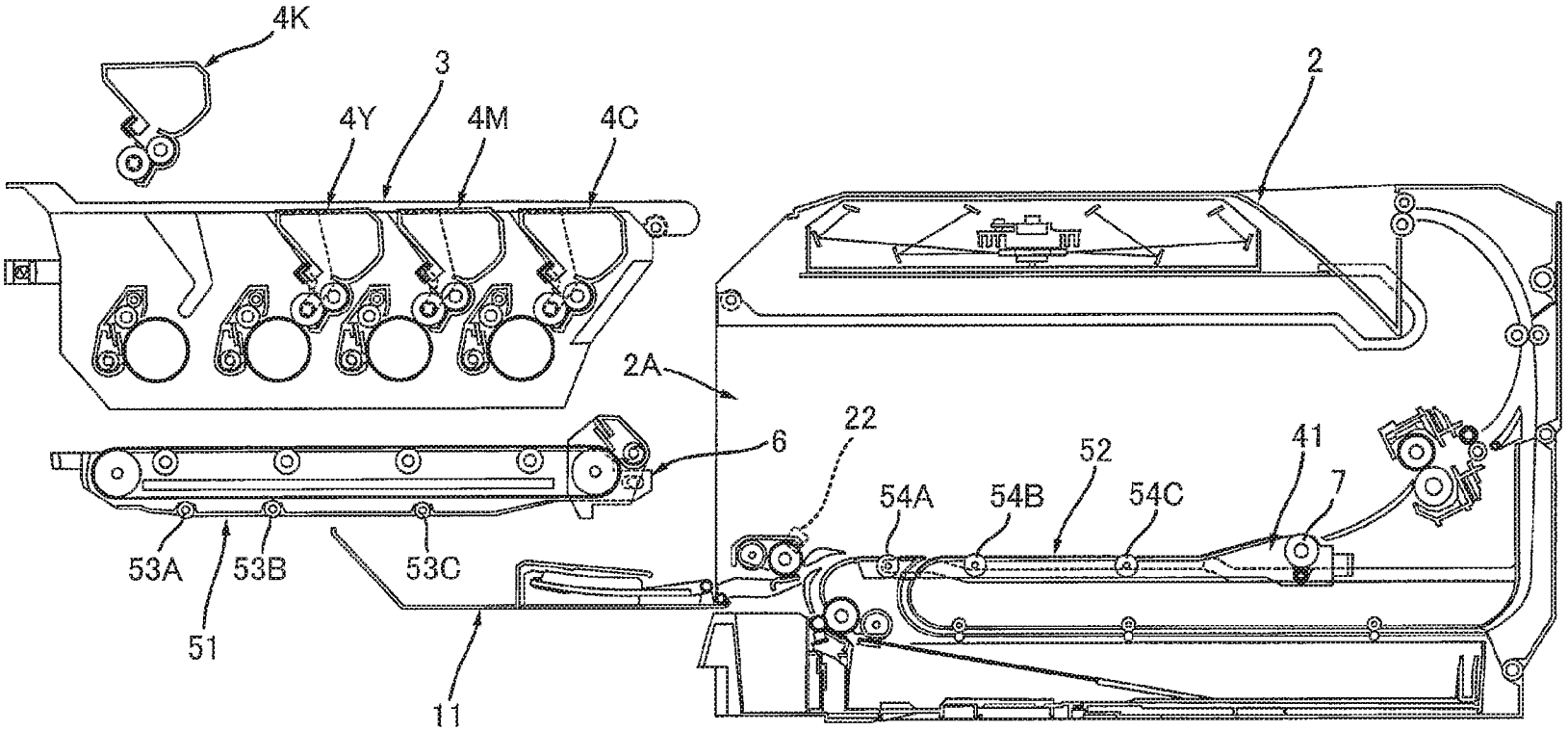
FIG. 2 is a view illustrating a state where a drum unit and a belt unit are detached from a main casing of the image forming apparatus according to the first embodiment.
Figure 3:
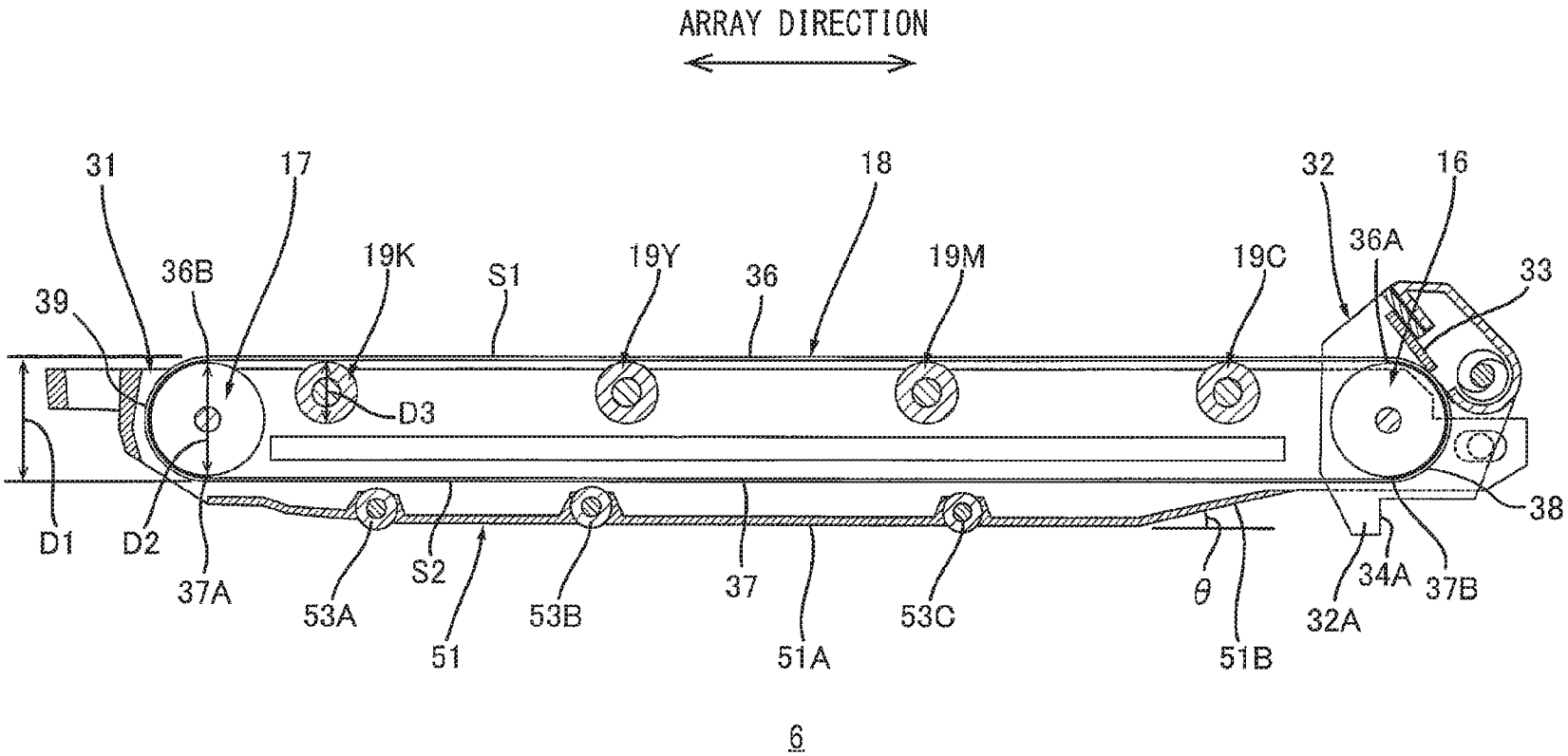
FIG. 3 is a cross-sectional view of the belt unit.

As illustrated in FIG. 2, the belt unit 6 is detachable from and attachable to the main casing 2 through the first opening 2A. As illustrated in FIG. 3, the belt unit 6 further includes a frame 31, a frame 32, a belt cleaning blade 33, and two protrusions 32A and 32B (see FIG. 5), in addition to the first roller 16, the second roller 17, the intermediate transfer bel 18, and the plurality of primary transfer rollers 19K, 19Y, 19M, and 19C described above.

<2.1 Frame 31>

The frame 31 supports the second roller 17 and the plurality of primary transfer rollers 19K, 19Y, 19M, and 19C. The frame 31 extends in the array direction.

<2.2 Frame 32>

The frame 32 supports the first roller 16 and the belt cleaning blade 33. The frame 32 is movable together with the first roller 16. The frame 32 is movable in the array direction relative to the frame 31. The frame 32 is urged by a spring (not illustrated) in the direction away from the second roller 17 in the array direction. With this configuration, the first roller 16 applies a tensile force to the intermediate transfer belt 18 directed in the direction away from the second roller 17.

<2.3 Intermediate Transfer Belt 18>

The intermediate transfer belt 18 is strained due to the tensile force applied by the first roller 16 while the intermediate transfer belt 18 is mounted over the first roller 16 and the second roller 17. The intermediate transfer belt 18 includes the first portion 36, a second portion 37, a third portion 38, and fourth portion 39.

The first portion 36 is positioned between the first roller 16 and the second roller 17, and extends in the array direction. The first portion 36 has a generally flat shape. The term "generally flat shape" denotes that the first portion 36 is sufficiently flat that the toner images on the photosensitive drums 13K, 13Y, 13M, and 13C can be superposed with each other on the first portion 36 where necessary and can be conveyed thereon. The first portion 36 may have a minute distortion and surface unevenness as long as an image with a desired quality can be formed. The first portion 36 is moved in a first direction directed from the first roller 16 toward the second roller 17 when the intermediate transfer belt 18 is circularly moved over the first roller 16 and the second roller 17. The first portion 36 has an upstream end 36A and a downstream end 36B in the first direction. The upstream end 36A is in contact with the first roller 16, and the downstream end 36B is in contact with the second roller 17.

The second portion 37 is positioned between the first roller 16 and the second roller 17. The second portion 37 is positioned opposite to the first portion 36 with respect to the primary transfer roller 19K, and is spaced apart from the first portion 36. The second portion 37 is also spaced apart from the plurality of primary transfer rollers 19K, 19Y, 19M, and 19C.

A maximum distance D1 between an outer surface S1 of the first portion 36 and an outer surface S2 of the second portion 37 is not less than 1.0 times a diameter D2 of the second roller 17, and not more than 1.5 times the diameter D2. With such a dimensional relationship, a user can estimate a position of the intermediate transfer belt 18 on a basis of the diameter D2 of the second roller 17 when the user detaches the belt unit 6 from the main casing 2 and attaches the belt unit 6 to the main casing 2. Accordingly, inadvertent contact of the intermediate transfer belt 18 with a component(s) inside the main casing 2 can be restrained.

Note that a diameter of the first roller 16 may be greater than the diameter D2 of the second roller 17. In this case, the diameter of the first roller 16 is the maximum distance D1 between the outer surface S1 of the first portion 36 and the outer surface S2 of the second portion 37. That is, provided that the diameter of the first roller 16 is set to be not less than 1.0 times the diameter D2 and not more than 1.5 times the diameter D2, the maximum distance D1 and the diameter D2 can be set to the dimensional relationship described above.

Further, the maximum distance D1 between the outer surface 51 of the first portion 36 and the outer surface S2 of the second portion 37 is not less than 1.5 times a diameter D3 of the primary transfer roller 19K, and not more than 4 times the diameter D3. Such a dimensional relationship can stabilize movement of the intermediate transfer belt 18.

The second portion 37 extends in the array direction, and has a generally flat shape similar to the first portion 36. The second portion 37 only contacts the first roller and the second roller 17. More specifically, the second portion 37 has an inner surface that only contacts the first roller 16 and the second roller 17. That is, the second portion 37 keeps its generally flat shape only by the tensile force applied by the first roller 16. Accordingly, vibration of the second portion 37 can be restrained during movement of the intermediate transfer belt 18 over the first roller 16 and the second roller 17. Consequently, the toner image can be conveyed to the secondary transfer roller 7 (see FIG. 1) while restraining deterioration of the toner image. The second portion 37 is moved in a second direction directed from the second roller 17 toward the first roller 16 when the intermediate transfer belt 18 is circularly moved over the first roller 16 and the second roller 17. The second portion 37 has an upstream end 37A and a downstream end 37B in the second direction. The upstream end 37A is in contact with the second roller 17, and the downstream end 37B is in contact with the first roller 16.

The third portion 38 is positioned between the first portion 36 and the second portion 37, and in contact with an outer circumferential surface of the first roller 16. More specifically, the third portion 38 extends between the upstream end 36A of the first portion 36 and the downstream end 37B of the second portion 37. The third portion 38 is moved along the outer circumferential surface of the first roller 16 from the downstream end 37B of the second portion 37 toward the upstream end 36A of the first portion 36 when the intermediate transfer belt 18 is circularly moved over the first roller 16 and the second roller 17.

The fourth portion 39 is positioned between the first portion 36 and the second portion 37, and in contact with an outer circumferential surface of the second roller 17. More specifically, the fourth portion 39 extends between the downstream end 36B of the first portion 36 and the upstream end 37A of the second portion 37. The fourth portion 39 is moved along the outer circumferential surface of the second roller 17 from the downstream end 36B of the first portion 36 toward the upstream end 37A of the second portion 37 when the intermediate transfer belt 18 is circularly moved over the first roller 16 and the second roller 17.

Note that, of the intermediate transfer belt 18, only the third portion 38 is in contact with the outer circumferential surface of the first roller 16, and only the fourth portion 39 is in contact with the outer circumferential surface of the second roller 17. That is, each of the first portion 36 and the second portion 37 is out of contact with the first roller 16 and the second roller 17.

<2.4 Belt Cleaning Blade 33>

The belt cleaning blade 33 is configured to remove residual toner from the intermediate transfer belt 18, and is provided at the frame 32. The belt cleaning blade 33 is positioned between the downstream end 37B of the second portion 37 and the upstream end 36A of the first portion 36 in the moving direction of the intermediate transfer belt 18. More specifically, the belt cleaning blade 33 is positioned downstream of the downstream end 37B of the second portion 37 and upstream of the upstream end 36A of the first portion 36 in the moving direction of the intermediate transfer belt 18.

The belt cleaning blade 33 is in contact with the intermediate transfer belt 18. More specifically, the belt cleaning blade 33 is in contact with the intermediate transfer belt 18 at a position closer to the upstream end 36A of the first portion 36 than to the downstream end 37B of the second portion 37. The belt cleaning blade 33 is disposed at a position offset from a sheet conveying passage directed from a position between the intermediate transfer belt 18 and the secondary transfer roller 7 to the fixing unit 8. With this configuration, the belt cleaning blade 33 does not prevent the sheet S passed through the position between the secondary transfer roller 7 and the intermediate transfer belt 18 to be conveyed toward the fixing unit 8. The residual toner removed by the belt cleaning blade 33 is accommodated in the frame 32.

<2.5 Protrusions 32A and 32B>

As illustrated in FIG. 3, the protrusion 32A is provided at the frame 32. Thus, the protrusion 32A is movable together with the first roller 16 relative to the second roller 17.

Figure 5:
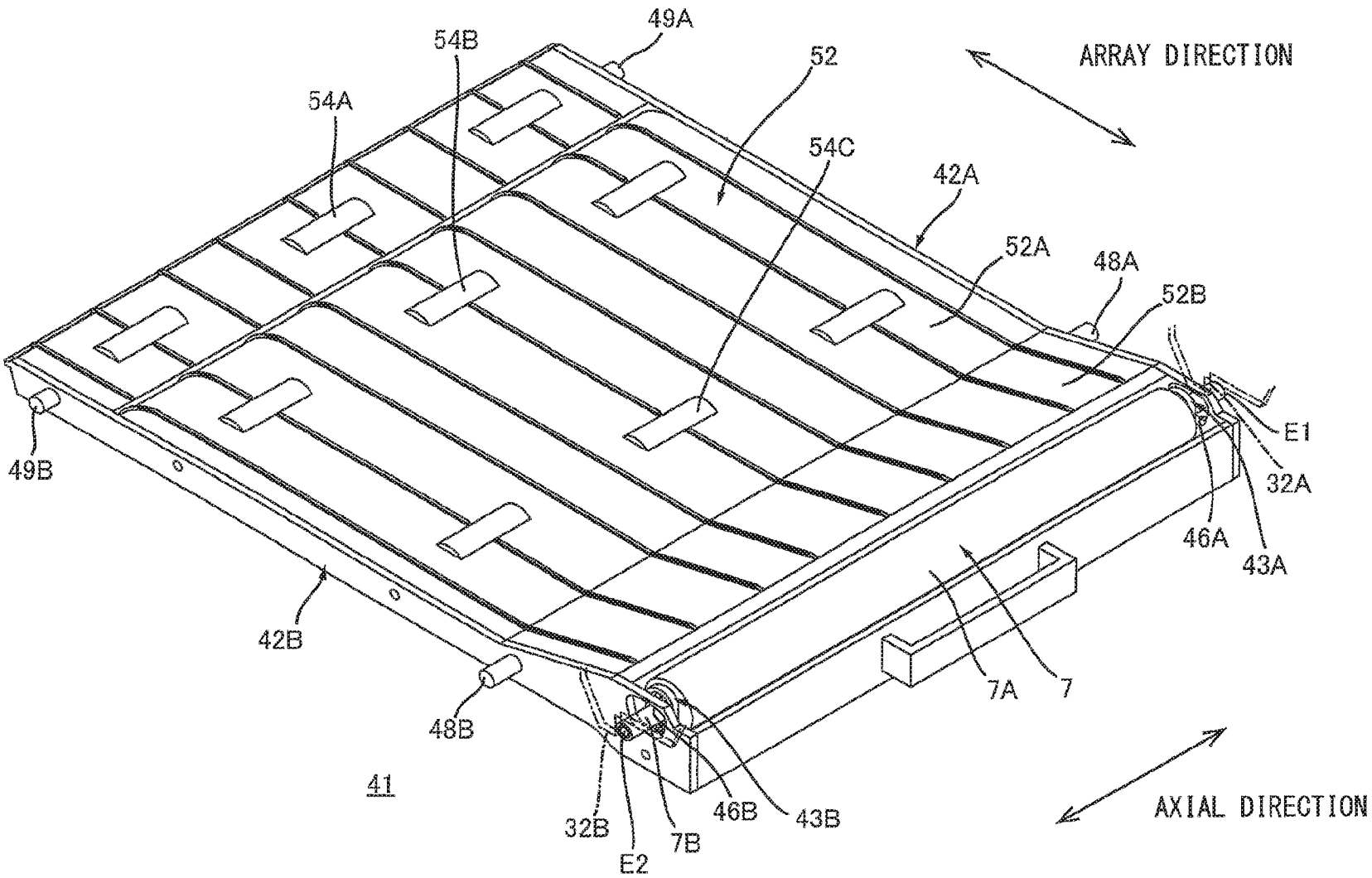
FIG. 5 is a perspective view of the secondary transfer unit.

As illustrated in FIG. 5, the protrusion 32A is in contact with one end portion E1 of a shaft 7B of the secondary transfer roller 7 in a state where the belt unit 6 and the secondary transfer unit 41 are attached to the main casing 2. The protrusion 32A is positioned opposite to a side plate 42B of the secondary transfer unit 41 with respect to a side plate 42A of the secondary transfer unit 41 in the axial direction in a state where the belt unit 6 and the secondary transfer unit 41 are attached to the main casing 2. Further, the protrusion 32A is positioned opposite to the second opening 2B with respect to the shaft 7B of the secondary transfer roller 7 in a state where the secondary transfer roller 7 is attached to the main casing 2. In other words, the protrusion 32A is positioned opposite to the second cover 12 in the closing position with respect to the shaft 7B of the secondary transfer roller 7 in a state where the secondary transfer roller 7 is attached to the main casing 2.

As illustrated in FIG. 3, the protrusion 32A protrudes from the frame 32. The protrusion 32A protrudes in a direction directed from the first portion 36 to the second portion 37. The protrusion 32A has a contact surface 34A. The contact surface 34A contacts the one end portion E1 (see FIG. 5) of the shaft 7B of the secondary transfer roller 7 in a state where the belt unit 6 and the secondary transfer unit 41 are attached to the main casing 2. The contact surface 34A extends in a direction crossing the array direction. In other words, the contact surface 34A extends in a direction crossing a direction in which the secondary transfer roller 7 is moved. Preferably, the contact surface 34A extends in a direction perpendicular to the direction in which the secondary transfer roller 7 is moved.

As illustrated in FIG. 5, the protrusion 32B is in contact with another end portion E2 of the shaft 7B of the secondary transfer roller 7 in a state where the belt unit 6 and the secondary transfer unit 41 are attached to the main casing 2. The protrusion 32B is spaced apart from the protrusion 32A in the axial direction. The protrusion 32B is positioned opposite to the side plate 42A with respect to the side plate 42B in the axial direction in a state where the belt unit 6 and the secondary transfer unit 41 are attached to the main casing 2. The protrusion 32B has a shape the same as that of the protrusion 32A.

Note that the protrusion 32B is provided at the frame 32 (see FIG. 3) similar to the protrusion 32A. With such a configuration, the protrusion 32B is movable together with the first roller 16 relative to the second roller 17.

3. Secondary Transfer Unit 41

Next, the secondary transfer unit 41 will be described in detail.

Figure 4:
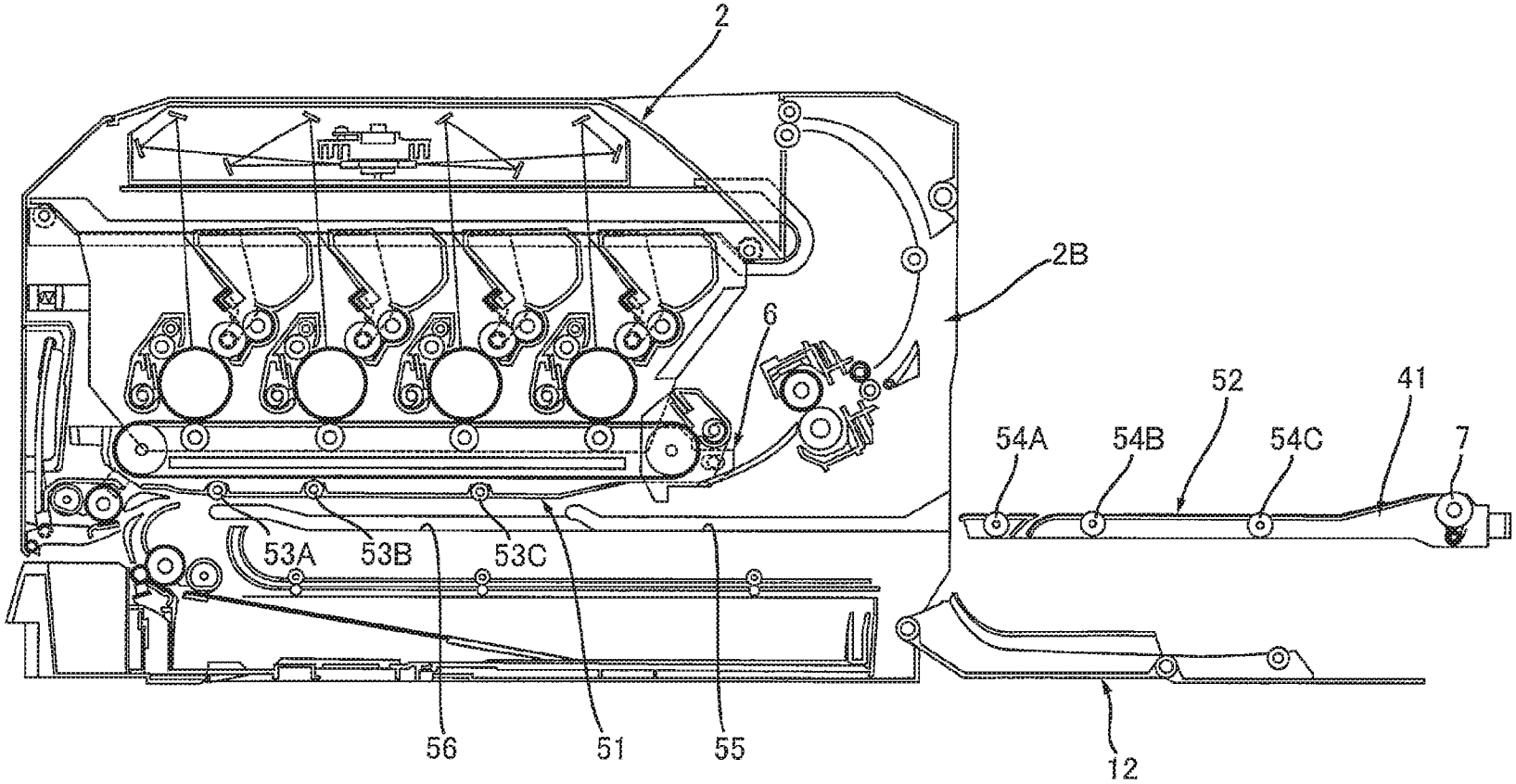
FIG. 4 is a view illustrating a state where a secondary transfer unit of the image forming apparatus according to the first embodiment is detached from the main casing.

As illustrated in FIG. 4, the secondary transfer unit 41 is detachable from and attachable to the main casing 2 through the second opening 2B. Further, as illustrated in FIG. 5, the secondary transfer unit 41 further includes the pair of side plates 42A and 42B, a pair of support members 43A and 43B, a pair of compression springs 44A and 44B (see FIG. 8), and a pair of torsion springs 45A and 45B (see FIG. 8).

<3.1 Secondary Transfer Roller 7>

In a state where the belt unit 6 and the secondary transfer unit 41 are attached to the main casing 2, the secondary transfer roller 7 is in contact with the intermediate transfer belt 18 at a position closer to the downstream end 37B of the second portion 37 than to the upstream end 36A of the first portion 36 so that the intermediate transfer belt 18 is nipped between the secondary transfer roller 7 and the first roller 16. A portion of the intermediate transfer belt 18 that the secondary transfer roller 7 can contact will be described greater in detail.

Figure 7:
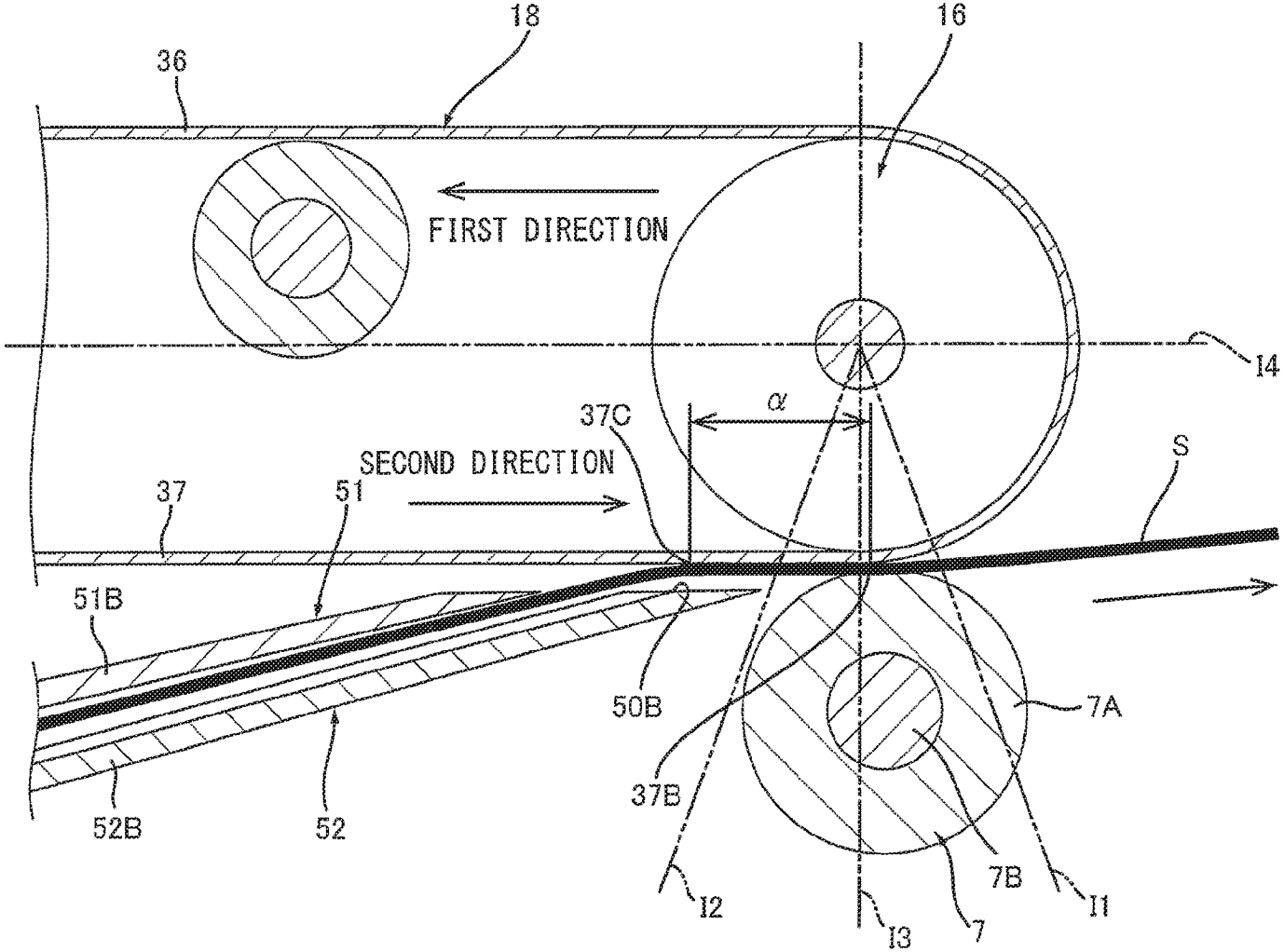
FIG. 7 is a view for description of arrangement of an intermediate transfer belt, a secondary transfer roller, and a sheet guide of the image forming apparatus according to the first embodiment.

Here, an imaginary plane I1, an imaginary plane I2, an imaginary plane I3, and an imaginary plane I4 is defined, as illustrated in FIG. 7. In a state where the belt unit 6 and the secondary transfer unit 41 are attached to the main casing 2, the secondary transfer roller 7 is in contact with the intermediate transfer belt 18 at a region between an imaginary plane I1 and an imaginary plane I2. The imaginary plane I3 is perpendicular to the imaginary plane I4 and passes through the rotational axis of the first roller 16. The imaginary plane I4 passes through both the rotational axis of the first roller 16 and the rotational axis of the second roller 17. Note that, of the imaginary plane I1, only a portion below the imaginary plane I4 (i.e., below the rotational axis of the first roller 16) is illustrated. Similarly, of the imaginary plane I2, only a portion below the imaginary plane I4 (i.e., below the rotational axis of the first roller 16) is illustrated.

The imaginary plane I1 is inclined relative to the imaginary plane I3 in a direction away from the second roller 17 (see FIG. 1). An angle defined by the imaginary plane I1 and the imaginary plane I3 is 20 degrees in the present embodiment. Preferably, the angle defined by the imaginary plane I1 and the imaginary plane I3 is 10 degrees. The imaginary plane I2 is inclined relative to the imaginary plane I3 in a direction toward the second roller 17 (see FIG. 1). An angle defined by the imaginary plane I2 and the imaginary plane I3 is 20 degrees in the present embodiment. Preferably, the angle defined by the imaginary plane I2 and the imaginary plane I3 is 10 degrees. More specifically, the secondary transfer roller 7 is in contact with the downstream end 37B of the second portion 37.

Figure 8:
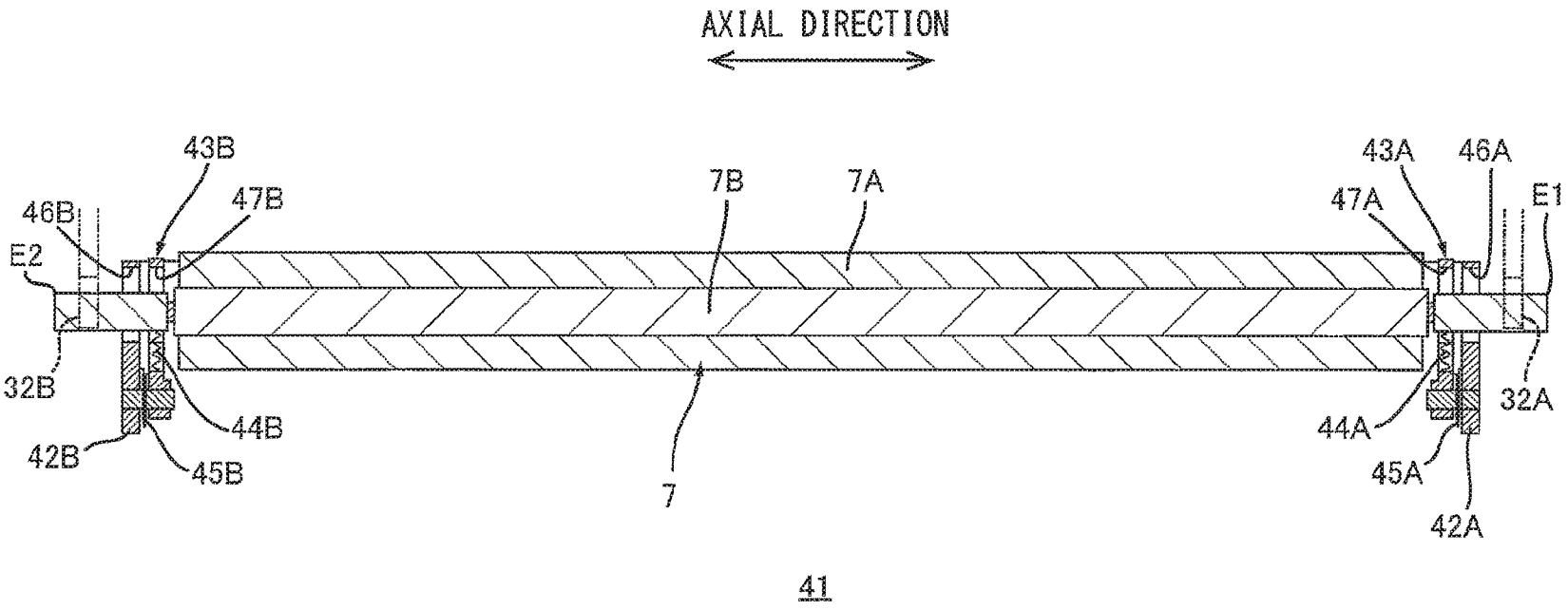
FIG. 8 is a cross-sectional view of the secondary transfer unit taken along a line A-A in FIG. 6.

As illustrated in FIG. 8, the secondary transfer roller 7 includes a roller body 7A and the shaft 7B.

The roller body 7A extends in the axial direction, and has a hollow cylindrical shape. The roller body 7A is positioned between the side plates 42A and the 42B in the axial direction.

The shaft 7B extends in the axial direction. The shaft 7B is positioned radially inside the roller body 7A, and has a solid cylindrical shape. The shaft 7B has the one end portion E1 and the other end portion E2 in the axial direction.

The one end portion E1 protrudes from one end of the roller body 7A in the axial direction, and extends through a through-hole 46A of the side plate 42A. The one end portion E1 is positioned opposite to the roller body 7A with respect to the side plate 42A in the axial direction. The one end portion E1 is in contact with the protrusion 32A of the belt unit 6 in a state where the belt unit 6 and the secondary transfer unit 41 are attached to the main casing 2.

The other end portion E2 protrudes from another end of the roller body 7A in the axial direction, and extends through a through-hole 46B of the side plate 42B. The other end portion E2 is positioned opposite to the roller body 7A with respect to the side plate 42B in the axial direction. The other end portion E2 is in contact with the protrusion 32B of the belt unit 6 in a state where the belt unit 6 and the secondary transfer unit 41 are attached to the main casing 2.

Figure 9A:
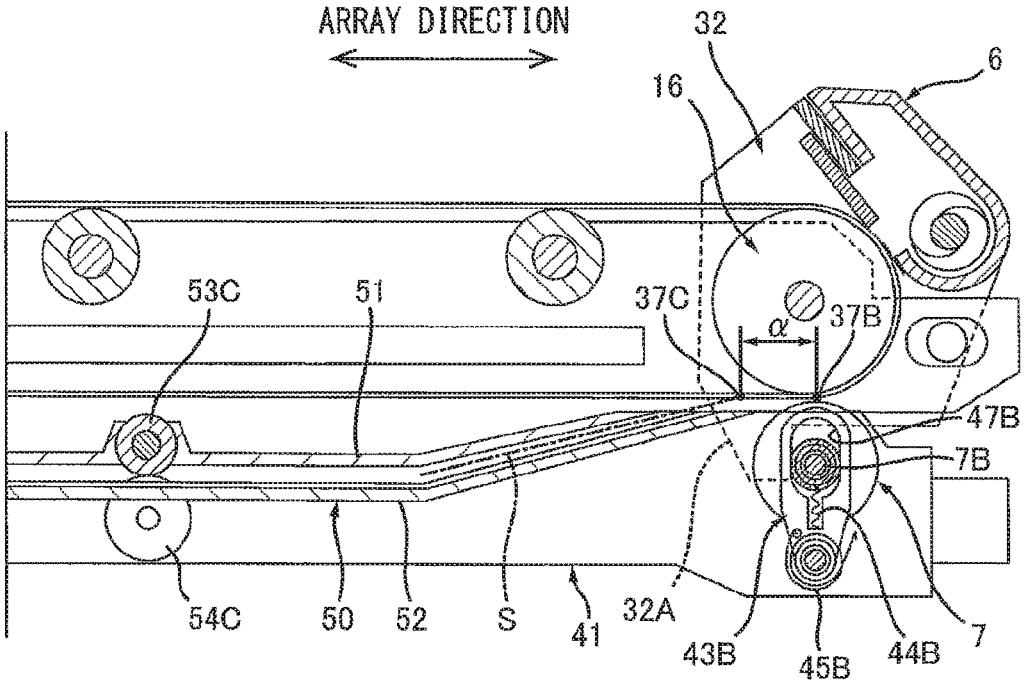
FIG. 9A is a view for description of a relationship between expansion of the intermediate transfer belt and displacement of secondary transfer roller, and illustrating a state the intermediate transfer belt is not expanded.
Figure 9B:
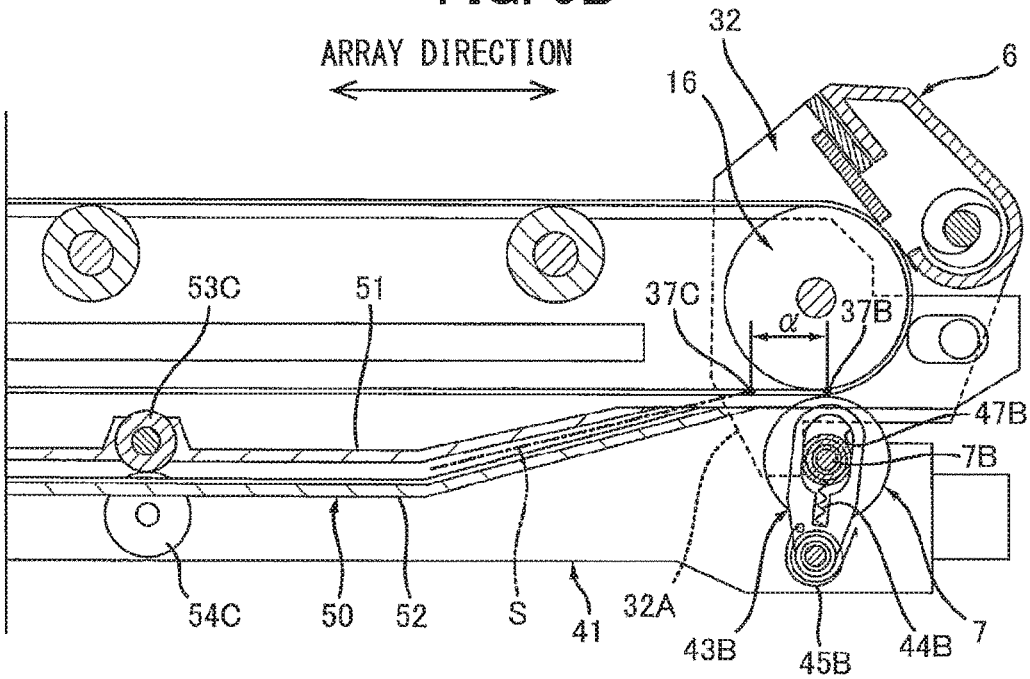
FIG. 9B is a view for description of the relationship between the expansion of the intermediate transfer belt and the displacement of secondary transfer roller, and illustrating a state the intermediate transfer belt is expanded.

As described above, the one end portion E1 and the other end portion E2 are in contact with the protrusion 32A and protrusion 32B, respectively, in a state where the belt unit 6 and the secondary transfer unit 41 are attached to the main casing 2. With this configuration, the secondary transfer roller 7 is movable together with the first roller 16 and the frame 32 in a state where the belt unit 6 and the secondary transfer unit 41 are attached to the main casing 2, as illustrated in FIGS. 9A and 9B. In this state, the secondary transfer roller 7 is movable in the array direction. As illustrated in FIG. 9B, the secondary transfer roller 7 is movable together with movement the first roller 16 and the frame 32 caused by the expansion and the contraction of the intermediate transfer belt 18.

Specifically, as illustrated in FIGS. 9A and 9B, the other end portion E2 of the shaft 7B is urged toward the first roller 16 by the compression spring 44B. Further, the support member 43B supporting the other end portion E2 of the shaft 7B is urged by the torsion spring 45B so that the shaft 7B approaches the protrusion 32B of the belt unit 6. The same is true with respect to the one end portion E1 of the shaft 7B.

Here, when the intermediate transfer belt 18 is expanded and contracted, the downstream end 37B of the second portion 37 and the secondary transfer roller 7 are moved in accordance with the expansion and the contraction of the intermediate transfer belt 18. That is, a nipping position between the intermediate transfer belt 18 and the secondary transfer roller 7 is displaced in accordance with the expansion and the contraction of the intermediate transfer belt 18.

On the other hand, a contact start position 37C of the second portion 37 at which the sheet S firstly contacts the second portion 37 of the intermediate transfer belt 18 and a primary transfer position at which the toner image is firstly transferred to the intermediate transfer belt 18 are not moved regardless of the movement of the intermediate transfer belt 18. This is because the contact start position 37C is not determined by the expansion and the contraction of the intermediate transfer belt 18 but is determined by the conveying passage of the sheet S. Similarly, the primary transfer position is determined by positions of the photosensitive drums 13K, 13Y, 13M, and 13C, and therefore the primary transfer position is not moved due to the expansion and the contraction of the intermediate transfer belt 18.

With this configuration, the position of the conveyed sheet S relative to the primarily transferred toner image can be maintained constant even when the intermediate transfer belt 18 is expanded and contracted.

<3.2 Side Plate 42A>

As illustrated in FIGS. 5 and 8, the side plate 42A constitutes one end portion of the secondary transfer unit 41 in the axial direction, and extends in the array direction. The side plate 42A is formed with the through-hole 46A, and includes a boss 48A and a boss 49A.

The one end portion E1 of the shaft 7B is inserted through the through-hole 46A. The through-hole 46A is elongated in the array direction so as to permit the secondary transfer roller 7 to be moved in the array direction.

The boss 48A has a solid cylindrical shape extending in the axial direction. The boss 48A is positioned opposite to the side plate 42B with respect to the side plate 42A in the axial direction. The boss 48A is fitted into a guide 55 (see FIG. 4) of the main casing 2. Note that the guide 55 extends in a direction in which the secondary transfer unit 41 is attached to the main casing 2. More specifically, the guide 55 extends in the array direction.

The boss 49A has a solid cylindrical shape extending in the axial direction. The boss 49A is positioned opposite to the side plate 42B with respect to the side plate 42A in the axial direction. The boss 49A is spaced apart from the boss 48A in the array direction. Further, the boss 49A is positioned opposite to the secondary transfer roller 7 with respect to the boss 48A. The boss 49A is fitted into a guide 56 (see FIG. 4) of the main casing 2. Note that guide 56 extends in the direction in which the secondary transfer unit 41 is attached to the main casing 2. More specifically, the guide 56 extends in the array direction.

<3.3 Side Plate 42B>

Figure 6:
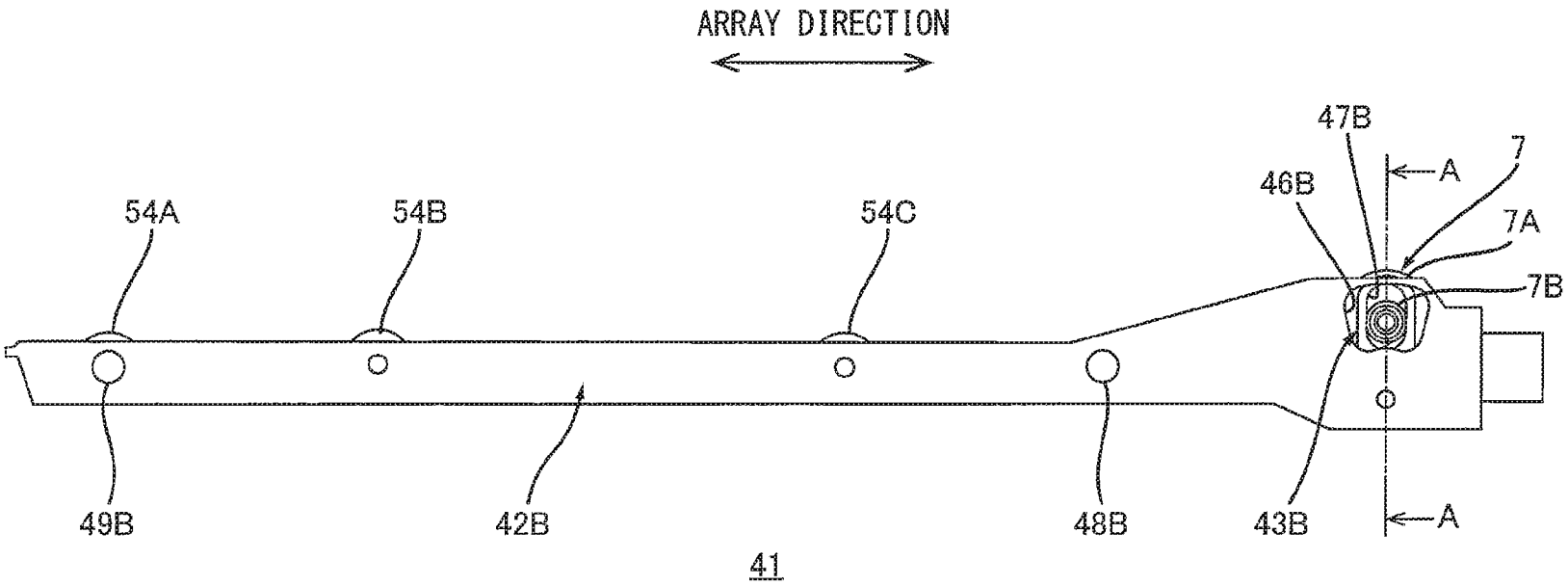
FIG. 6 is a side view of the secondary transfer unit illustrated in FIG. 5.

The side plate 42B constitutes another end portion of the secondary transfer unit 41 in the axial direction. The side plate 42B is positioned away from the side plate 42A in the axial direction. As illustrated in FIGS. 5 and 6, the side plate 42B is formed with the through-hole 46B, and includes a boss 48B and a boss 49B.

The other end portion E2 of the shaft 7B is inserted through the through-hole 46B. Similar to the through-hole 46A, the through-hole 46B is elongated in the array direction so that the secondary transfer roller 7 is movable in the array direction.

The boss 48B has a shape the same as the boss 48A. The boss 48B is positioned opposite to the boss 48A with respect to the side plate 42B in the axial direction. The boss 48B is fitted into a guide (not illustrated) of the main casing 2. The guide has a shape the same as the guide 55.

The boss 49B has a shape identical to the boss 49A. The boss 49B is positioned opposite to the boss 49A with respect to the side plate 42B in the axial direction. The boss 49B is fitted into a guide (not illustrated) of the main casing 2. The guide has a shape the same as the second guide 56.

<3.4 Support Members 43A and 43B>

As illustrated in FIG. 8, the support member 43A supports the one end portion E1 of the shaft 7B of the secondary transfer roller 7. The support member 43A is positioned between the roller body 7A of the secondary transfer roller 7 and the side plate 42A in the axial direction. The support member 43A is formed with a through-hole 47A into which the one end portion E1 of the shaft 7B of the secondary transfer roller 7 is inserted. The through-hole 47A has a shape the same as that of a through-hole 47B (described later) of the support member 43B. The support member 43A is pivotally movable relative to the side plate 42A. More specifically, the support member 43A is pivotably movably attached to the side plate 42A.

The support member 43B supports the other end portion E2 of the shaft 7B of the secondary transfer roller 7. The support member 43B is positioned between the roller body 7A of the secondary transfer roller 7 and the side plate 42B in the axial direction. The support member 43B is formed with the through-hole 47B into which the other end portion E2 of the shaft 7B of the secondary transfer roller 7 is inserted. The through-hole 47B is a long hole elongated in an upward/downward direction (see FIG. 9A). The support member 43B is pivotally movable relative to the side plate 42B. Specifically, the support member 43B is pivotally movably attached to the side plate 42B.

Since the one end portion E1 and the other end portion E2 of the shaft 7B are inserted into the through-hole 47A and the through-hole 47B, respectively, the secondary transfer roller 7 is movable in the upward/downward direction. That is, the secondary transfer roller 7 is movable toward and away from the first roller 16 in a state where the belt unit 6 and the secondary transfer unit 41 are attached to the main casing 2.

Further, as described above, the support member 43A is pivotally movable relative to the side plate 42A, and the support member 43B is pivotally movable relative to the side plate 42B. With this configuration, the secondary transfer roller 7 is also movable in the array direction.

<3.5 Compression Springs 44A and 44B>

The compression spring 44A is configured to urge the one end portion E1 of the shaft 7B of the secondary transfer roller 7 toward the first roller 16 in a state where the belt unit 6 and the secondary transfer unit 41 are attached to the main casing 2. The compression spring 44A is attached to the support member 43A, and is in contact with the one end portion E1 of the shaft 7B of the secondary transfer roller 7.

The compression spring 44B is configured to urge the other end portion E2 of the shaft 7B of the secondary transfer roller 7 toward the first roller 16 in a state where the belt unit 6 and the secondary transfer unit 41 are attached to the main casing 2. The compression spring 44B is attached to the support member 43B, and is in contact with the other end portion E2 of the shaft 7B of the secondary transfer roller 7.

<3.6 Torsion Springs 45A and 45B>

The torsion spring 45A is configured to urge the support member 43A such that the shaft 7B of the secondary transfer roller 7 approaches the protrusion 32A in a state where the belt unit 6 and the secondary transfer unit 41 are attached to the main casing 2. The torsion spring 45A is positioned between the support member 43A and the side plate 42A in the axial direction. One end of the torsion spring 45A is in contact with the support member 43A, and another end of the torsion spring 45A is in contact with the side plate 42A.

The torsion spring 45B is configured to urge the support member 43B in a direction the same as a direction in which the torsion spring 45A urges the support member 43A. The torsion spring 45B is positioned between the support member 43B and the side plate 42B in the axial direction. One end of the torsion spring 45B is in contact with the support member 43B, while another end of the torsion spring 45B is in contact with the side plate 42B.

4. Sheet Guide 50

The image forming apparatus 1 further includes a sheet guide 50, as illustrated in FIG. 1.

The sheet guide 50 is configured to guide the sheet S supplied by the sheet supply roller 21 toward the second portion 37 of the intermediate transfer belt 18. The sheet guide 50 is positioned opposite to the first portion 36 with respect to the second portion 37. The sheet guide 50 extends in the array direction, and extends along the second portion 37. The sheet guide 50 has an upstream end 50A and a downstream end 50B in a direction in which the sheet S is conveyed (hereinafter "sheet conveying direction"). The sheet guide 50 includes the first guide member 51 and a second guide member 52. The first guide member 51 is an example of a first sheet guide, and the second guide member 52 is an example of a second sheet guide.

<4.1 First Guide Member 51>

As illustrated in FIG. 3, the first guide member 51 is provided at the frame 31 of the belt unit 6. Hence, as illustrated in FIG. 2, the first guide member 51 is detachable together with the belt unit 6 from the main casing 2. More specifically, the first guide member 51 is detachable together with the belt unit 6 from the main casing 2 through the first opening 2A. Accordingly, when the belt unit 6 is detached from the main casing 2, the first guide member 51 is positioned away from the second guide member 52, thereby opening the sheet guide 50. Thus, even when a sheet S is jammed at an interior of the sheet guide 50, the jammed sheet S can be removed by detaching the belt unit 6 from the main casing 2. As illustrated in FIG. 3, the first guide member 51 includes a horizontal portion 51A and an inclined portion 51B.

The horizontal portion 51A extends in the array direction and extends along the second portion 37 of the intermediate transfer belt 18. The horizontal portion 51A includes the plurality of first conveying rollers 53A, 53B, and 53C arrayed in the array direction. Each of the plurality of first conveying rollers 53A, 53B, and 53C is configured to convey the sheet S. The first conveying roller 53B is positioned downstream of the first conveying roller 53A in the sheet conveying direction with a space between the first conveying roller 53A and the first conveying roller 53B. The first conveying roller 53C is positioned downstream of the first conveying roller 53B in the sheet conveying direction with a space between the first conveying roller 53B and the first conveying roller 53C.

The inclined portion 51B is positioned downstream of the horizontal portion 51A in the sheet conveying direction. More specifically, the inclined portion 51B is positioned downstream of the first conveying roller 53C in the sheet conveying direction. The inclined portion 51B is inclined relative to the horizontal portion 51A. More specifically, the inclined portion 51B is inclined so as to approach the second portion 37 of the intermediate transfer belt 18 in the sheet conveying direction. An inclination angle θ of the inclined portion 51B relative to the horizontal portion 51A is, for example, not less than 5 degrees and not more than 20 degrees.

Incidentally, while the inclined portion 51B has a flat shape as illustrated in FIG. 5 in the present embodiment, the inclined portion 51B may have a curved shape or an S-shape as long as the inclined portion 51B can guide the sheet S toward the second portion 37 of the intermediate transfer belt 18.

<4.2 Second Guide Member 52>

As illustrated in FIG. 1, the second guide member 52 is positioned opposite to the intermediate transfer belt 18 with respect to the first guide member 51 in a state where the belt unit 6 and the secondary transfer unit 41 are attached to the main casing 2. As illustrated in FIG. 4, the second guide member 52 is provided at the secondary transfer unit 41. Hence, the second guide member 52 is detachable from the main casing 2 together with the secondary transfer roller 7. More specifically, the second guide member 52 is detachable from the main casing 2 together with the secondary transfer roller 7 through the second opening 2B. Accordingly, when the user detaches the secondary transfer unit 41 from the main casing 2, the second guide member 52 is positioned away from the first guide member 51, thereby opening the sheet guide 50. Thus, a sheet S jammed at the interior space of the sheet guide 50 can be easily removed even when the sheet S is jammed inside the sheet guide 50. As illustrated in FIG. 5, the second guide member 52 includes a horizontal portion 52A and an inclined portion 52B.

The horizontal portion 52A extends in the array direction. Further, the horizontal portion 52A extends along the horizontal portion 51A (see FIG. 3) of the first guide member 51 in a state where the belt unit 6 and the secondary transfer unit 41 are attached to the main casing 2.

The horizontal portion 52A includes the plurality of second conveying rollers 54A, 54B, and 54C arrayed in the array direction. The second conveying roller 54A is configured to convey the sheet S in cooperation with the first conveying roller 53A (see FIG. 1). The second conveying roller 54A is in contact with the first conveying roller 53A in a state where the belt unit 6 and the secondary transfer unit 41 are attached to the main casing 2. The second conveying roller 54B is configured to convey the sheet S in cooperation with the first conveying roller 53B (see FIG. 1). The second conveying roller 54B is in contact with the first conveying roller 53B in a state where the belt unit 6 and the secondary transfer unit 41 are attached to the main casing 2. The second conveying roller 54C is configured to convey the sheet S in cooperation with the first conveying roller 53C (see FIG. 1). The second conveying roller 54C is in contact with the first conveying roller 53C in a state where the belt unit 6 and the secondary transfer unit 41 are attached to the main casing 2.

The inclined portion 52B is positioned downstream of the horizontal portion 52A in the sheet conveying direction. More specifically, the inclined portion 52B is positioned downstream of the second conveying roller 54C in the sheet conveying direction. The inclined portion 52B is inclined relative to the horizontal portion 52A. As illustrated in FIG. 7, the inclined portion 52B extends along the inclined portion 51B in a state where the belt unit 6 and the secondary transfer unit 41 are attached to the main casing 2.

<4.3 Arrangement of Sheet Guide 50>

As illustrated in FIG. 7, the downstream end 50B of the sheet guide 50 is positioned between the first roller 16 and the second roller 17 (see FIG. 1), and is positioned closer to the first roller 16 than to the second roller 17. The downstream end 50B of the sheet guide 50 is positioned away from the secondary transfer roller 7 so as to obtain a desirable "contacting length α". The contacting length α is a length from the contact start position 37C at which the sheet S starts to contact the second portion 37 to the downstream end 37B of the second portion 37. The contact start position 37C is positioned upstream of the downstream end 37B of the second portion 37 in the second direction. That is, prior to contact of the sheet S to the secondary transfer roller 7, the sheet S maintains to contact the second portion 37 by the contacting length α. Note that the contact start position 37C is positioned closer to the downstream end 37B than to the upstream end 37A of the second portion 37.

The contacting length α is set to be in a range of from 25% to 200% of a diameter of the secondary transfer roller 7. Specifically, the contacting length α is not less than 4 mm and not more than 30 mm, for example. It is preferable that the contacting length α has a length not less than the diameter of the secondary transfer roller 7. More specifically, it is preferable that the contacting length α is not less than 10 mm Since the contacting length α by which the second portion 37 of the intermediate transfer belt 18 and the sheet S are in contact with each other is provided before the sheet S contacts the secondary transfer roller 7, the sheet S can contact the secondary transfer roller 7 while in contact with the second portion 37. The contact start position 37C is an example of a prescribed position, and the contacting length α is an example of a prescribed length.

With this arrangement, the sheet S can be easily conveyed along the second portion 37 of the intermediate transfer belt 18. Specifically, the sheet S can be brought into contact with the second portion 37 prior to contact of the sheet S with the secondary transfer roller 7, so that the sheet S can contact the secondary transfer roller 7 while the sheet S is in contact with the second portion 37.

5. Operational Advantages of the First Embodiment

In the image forming apparatus 1 according to the present embodiment, the secondary transfer roller 7 is in contact with the downstream end 37B of the second portion 37 in a state where the belt unit 6 and the secondary transfer unit 41 are attached to the main casing 2, as illustrated in FIG. 7.

Further, in the image forming apparatus 1 according to the present embodiment, the downstream end 50B of the sheet guide 50 is disposed so that the desirable contacting length α on the second portion 37 can be obtained between the contact start position 37C and the downstream end 37B of the second portion 37.

With the configuration described above, the sheet S can be easily conveyed along the second portion 37 of the intermediate transfer belt 18. Specifically, the sheet S and the second portion 37 are in contact with each other prior to the contact of the sheet S with the secondary transfer roller 7, so that the sheet S can be brought into contact with the secondary transfer roller 7 while the sheet S is in contact with the second portion 37.

Accordingly, occurrence of electric discharge between the sheet S and the intermediate transfer belt 18 due to the transfer current can be restrained.

As a result, variation in charge polarity of the toner caused by electric discharge can be restrained, thereby reliably transferring the toner image onto the sheet S.

6. Second Embodiment

An image forming apparatus 101 according to a second embodiment will next be described with reference to FIGS. 10 through 17B, wherein like parts and components are designated by the same reference numerals as those shown in the first embodiment.

Figure 10:
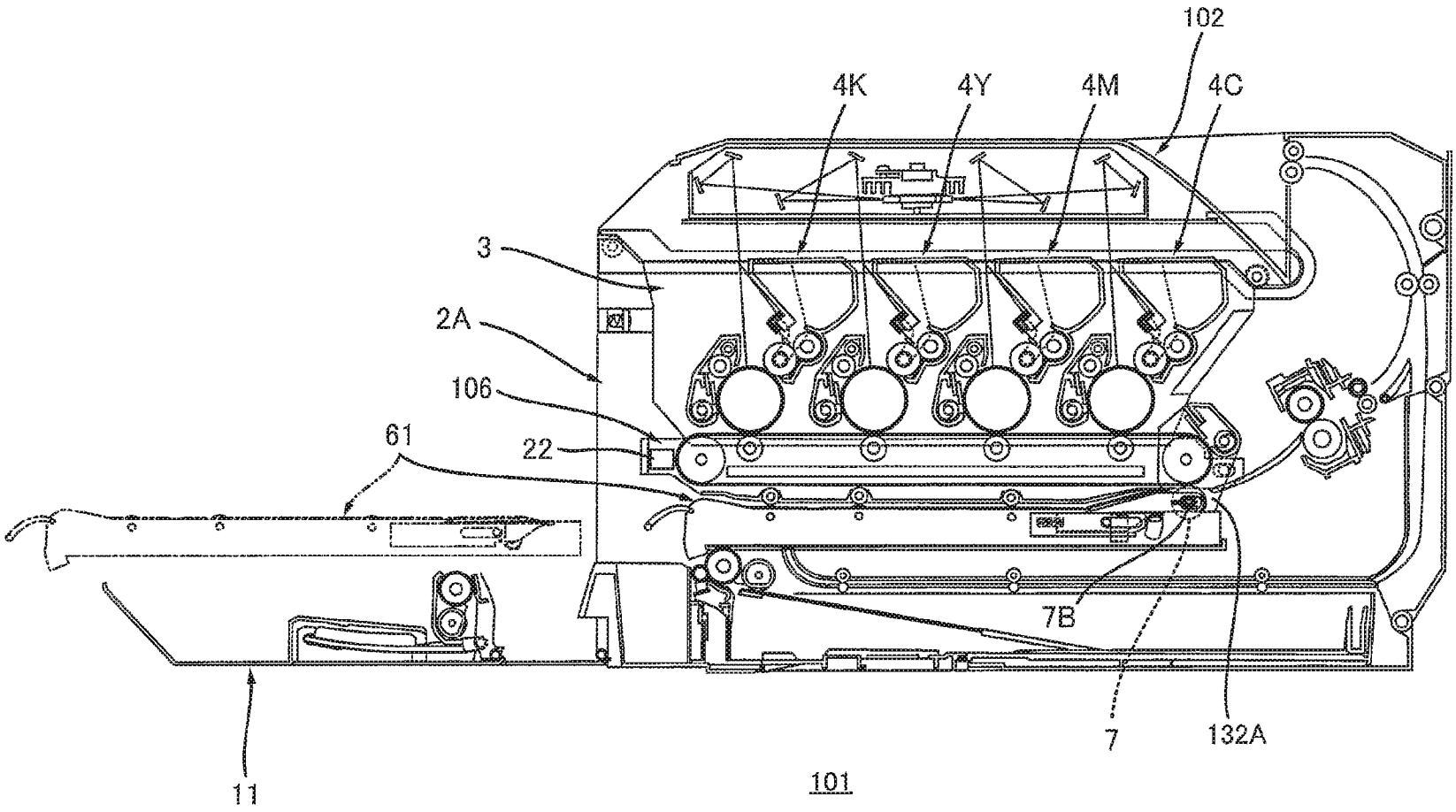
FIG. 10 is a schematic diagram illustrating a configuration of an image forming apparatus according to a second embodiment.

The image forming apparatus 101 includes a secondary transfer unit 61. As illustrated in FIG. 10, the secondary transfer unit 61 is detachable from a main casing 102 through the first opening 2A. That is, a second guide member 62 (see FIG. 11) is detachable from the main casing 102 together with the secondary transfer roller 7 (see FIG. 11) through the first opening 2A. Further, the secondary transfer unit 61 is attachable to the main casing 102 through the first opening 2A.

Incidentally, a protrusion 132A of a belt unit 106 is positioned opposite to the first opening 2A with respect to the shaft 7B of the secondary transfer roller 7 in a state where the secondary transfer roller 7 is attached to the main casing 102, as illustrated in FIG. 10.

Figure 11:
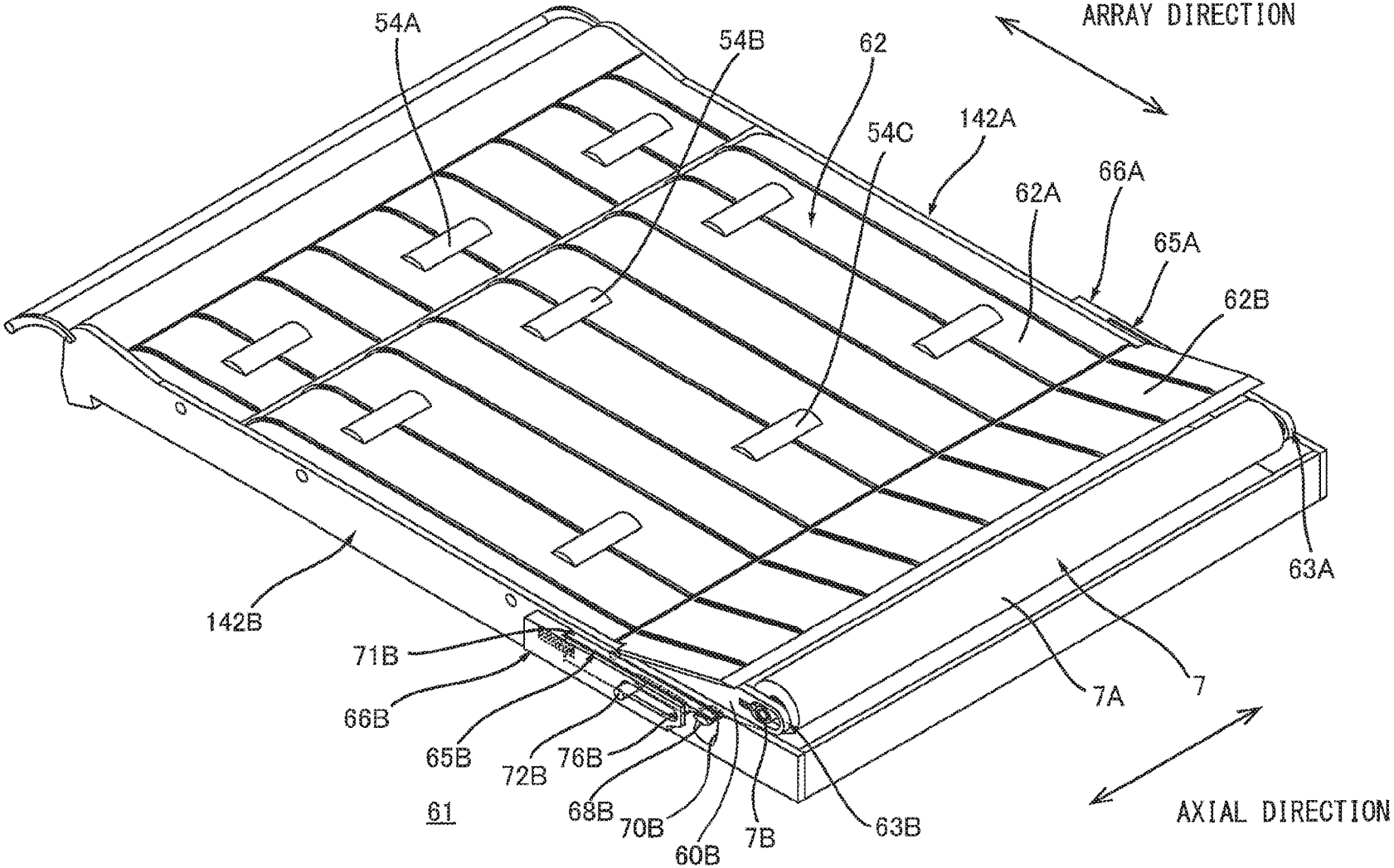
FIG. 11 is a perspective view of a secondary transfer unit of the image forming apparatus according to the second embodiment.

As illustrated in FIG. 11, the secondary transfer unit 61 includes the second guide member 62, a pair of arms 63A and 63B, a pair of compression springs 64A and 64B (see FIG. 13), a pair of cams 65A and 65B, and a pair of covers 66A and 66B. The second guide member 62 is another example of the second sheet guide.

<6.1 Second Guide Member 62>

Figure 14A:
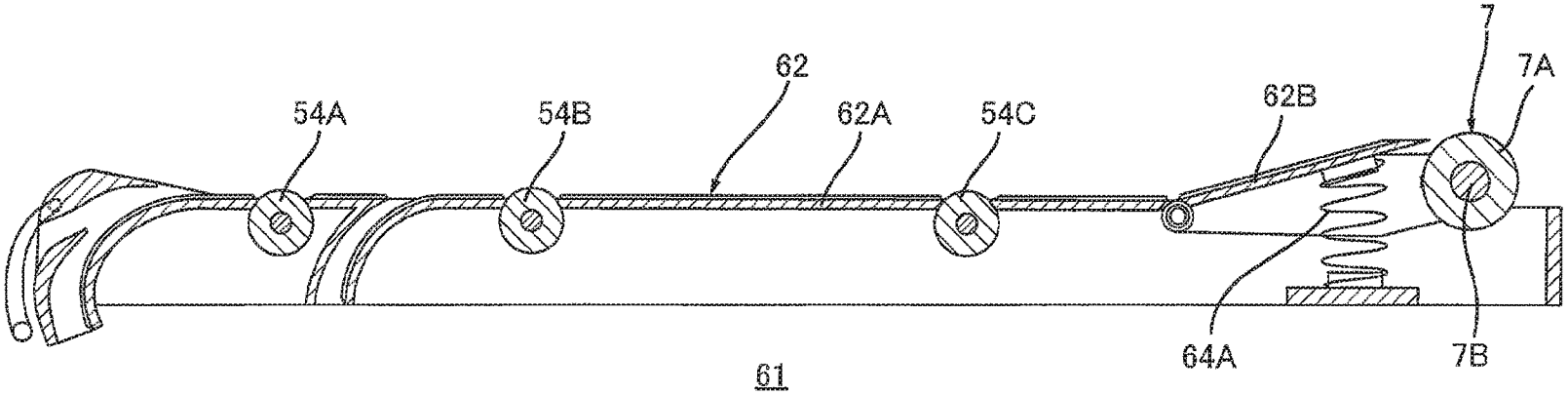
FIG. 14A is a cross-sectional view of the secondary transfer unit taken along a line C-C in FIG. 13, and illustrating a state where a second plate of a second guide member is at a first position and a secondary transfer roller is at a contact position.
Figure 14B:
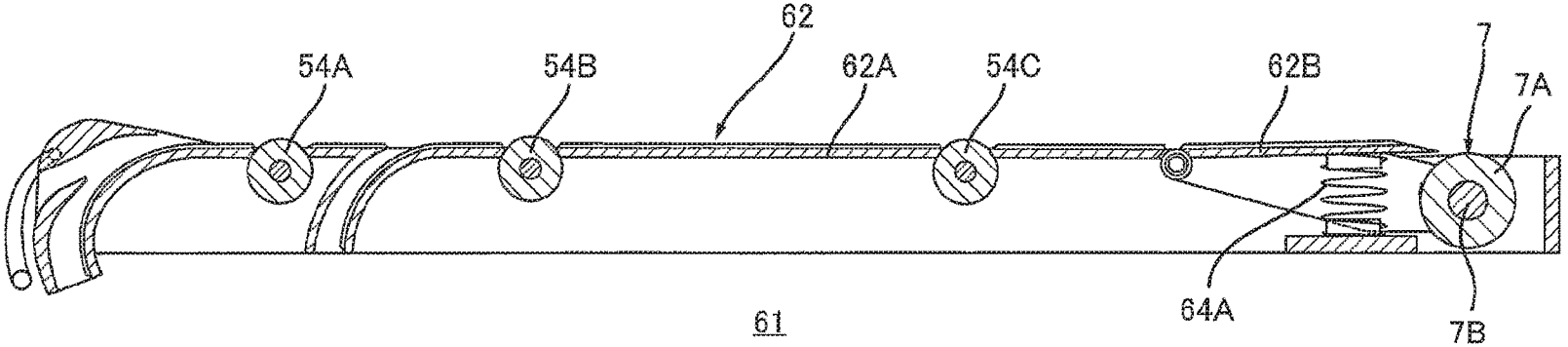
FIG. 14B is a cross-sectional view of the secondary transfer unit taken along the line C-C in FIG. 13, and illustrating a state where the second plate of the second guide member is at a second position and the secondary transfer roller is at a separation position.

As illustrated in FIGS. 11 and 14A, the second guide member 62 includes a first plate 62A and a second plate 62B.

Similar to the horizontal portion 52A of the second guide member 52 in the first embodiment, the first plate 62A extends along the horizontal portion 51A (see FIG. 17A) of the first guide member 51 in a state where the belt unit 106 and the secondary transfer unit 61 are attached to the main casing 102.

The second plate 62B is positioned downstream of the first plate 62A in the sheet conveying direction. More specifically, the second plate 62B is positioned downstream of the second conveying roller 54C in the sheet conveying direction. The second plate 62B is pivotally movable relative to the first plate 62A between a first position (see FIG. 14A) where the second plate 62B is inclined relative to the first plate 62A and a second position (see FIG. 14B) where the second plate 62B extends parallel to the first plate 62A. The second plate 62B is at the first position in a state where the secondary transfer unit 61 is attached to the main casing 102, and is at the second position in a state where the secondary transfer unit 61 is detached from the main casing 102.

<6.2 Compression Springs 64A and 64B>

Figure 13:
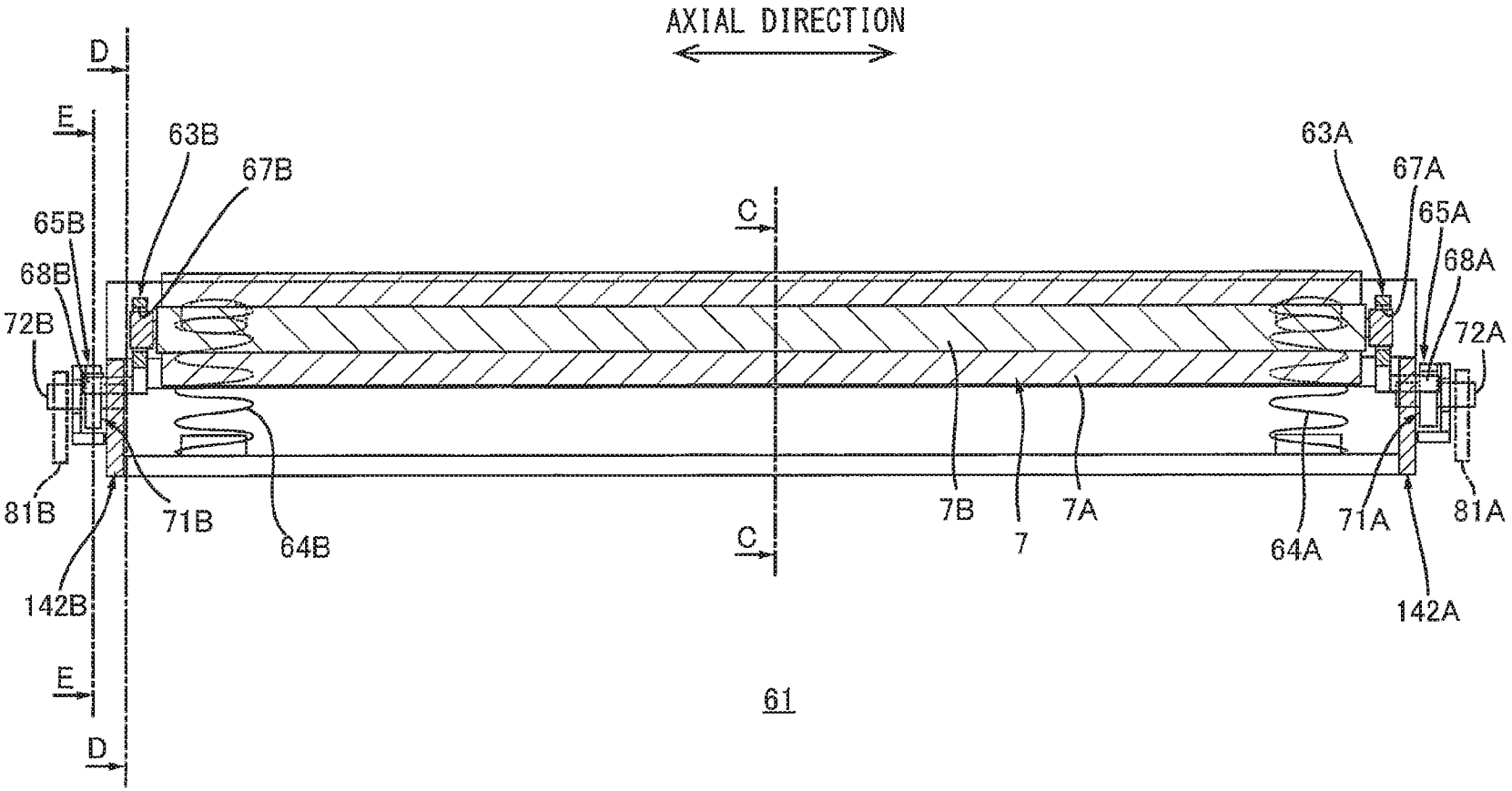
FIG. 13 is a cross-sectional view of the secondary transfer unit taken along a line B-B in FIG. 12.

As illustrated in FIGS. 13 and 14A, the compression springs 64A and 64B urge the second plate 62B in a direction directed from the second position toward the first position. Each of the compression springs 64A and 64B is disposed at a position below the second plate 62B, and is in contact with the second plate 62B. The compression springs 64A and 64B are spaced away from each other in the axial direction.

<6.3 Arms 63A and 63B>

As illustrated in FIGS. 11 and 13, the arm 63A supports the one end portion of the shaft 7B of the secondary transfer roller 7. The arm 63A extends from the second plate 62B. The arm 63A has a configuration the same as that of the arm 63B. Therefore, in the following description, the arm 63B will be described in detail while the description as to the arm 63A will be omitted.

Figure 15A:
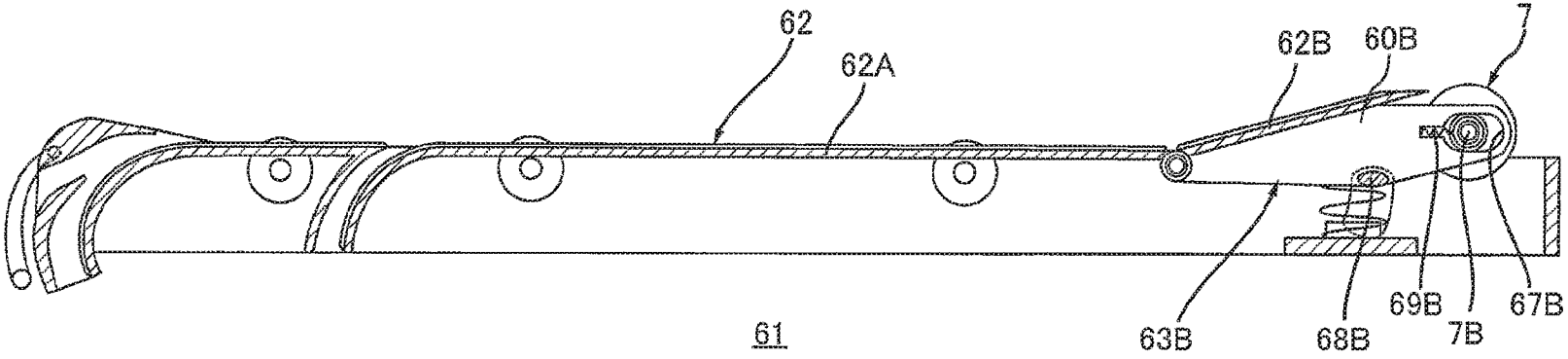
FIG. 15A is a cross-sectional view of the secondary transfer unit taken along a line D-D in FIG. 13, and illustrating a state where the second plate of the second guide member is at the first position and the secondary transfer roller is at the contact position.
Figure 15B:
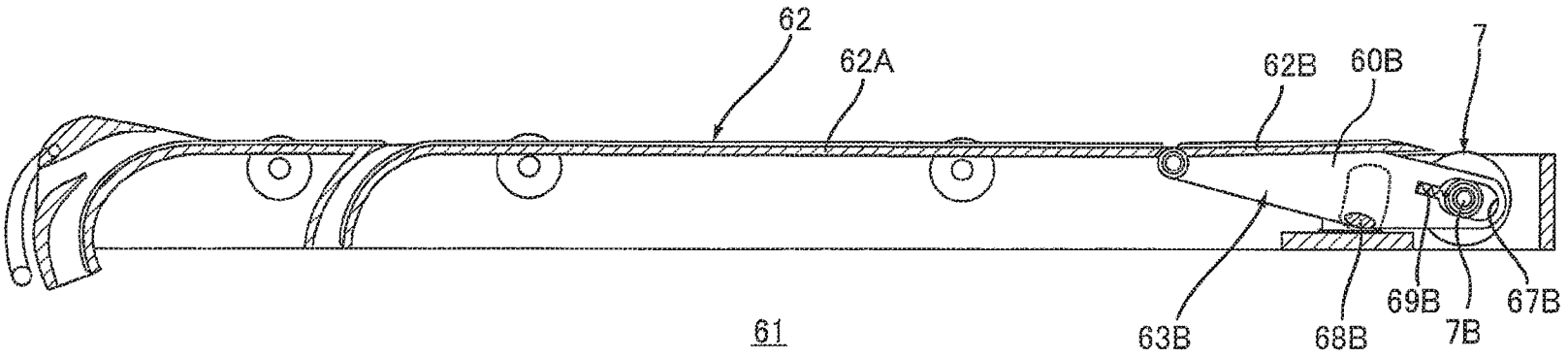
FIG. 15B is a cross-sectional view of the secondary transfer unit taken along the line D-D in FIG. 13, and illustrating a state where the second plate of the second guide member is at the second position and the secondary transfer roller is at the separation position.

The arm 63B supports the other end portion of the shaft 7B of the secondary transfer roller 7. The arm 63B is spaced apart from the arm 63A in the axial direction. The arm 63B extends from the second plate 62B. With this configuration, the arm 63B is movable together with the second plate 62B. As illustrated in FIGS. 15A and 15B, the arm 63B is formed with a through-hole 67B, and includes an arm body 60B, a boss 68B and a compression spring 69B.

The through-hole 67B is an elongated slot into which the other end portion of the shaft 7B of the secondary transfer roller 7 is inserted. The through-hole 67B is elongated in the array direction when the second plate 62B is at the first position. Accordingly, the secondary transfer roller 7 is movable in the array direction in the first position of the second plate 62B.

Figure 16A:
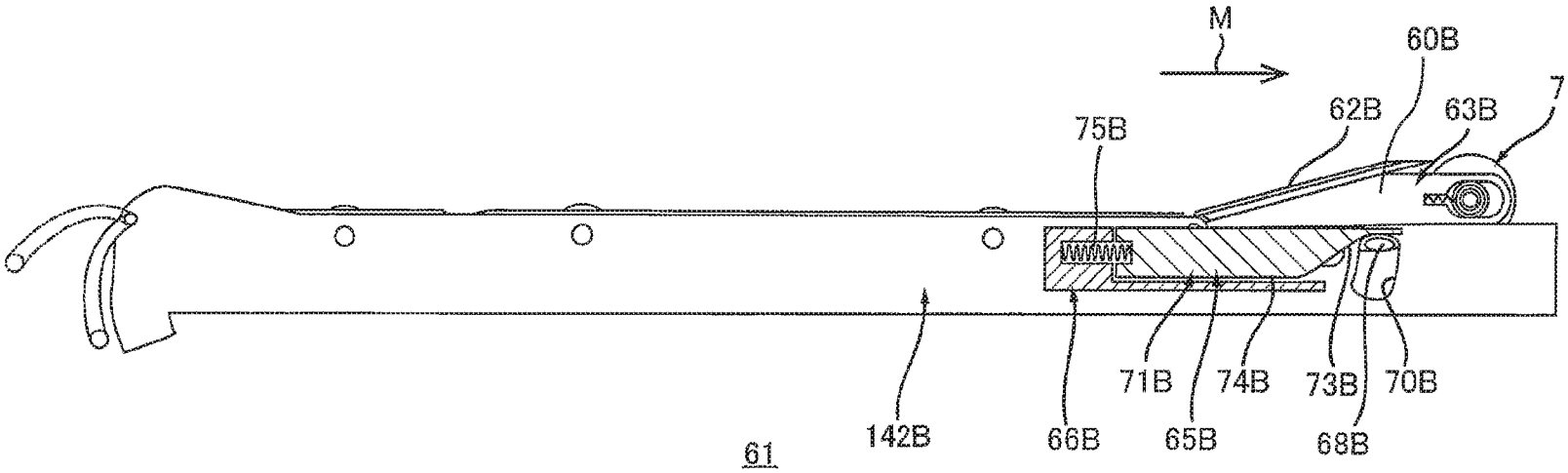
FIG. 16A is a cross-sectional view of the secondary transfer unit taken along a line E-E in FIG. 13, and illustrating a state where the second plate of the second guide member is at the first position and the secondary transfer roller is at the contact position.
Figure 16B:
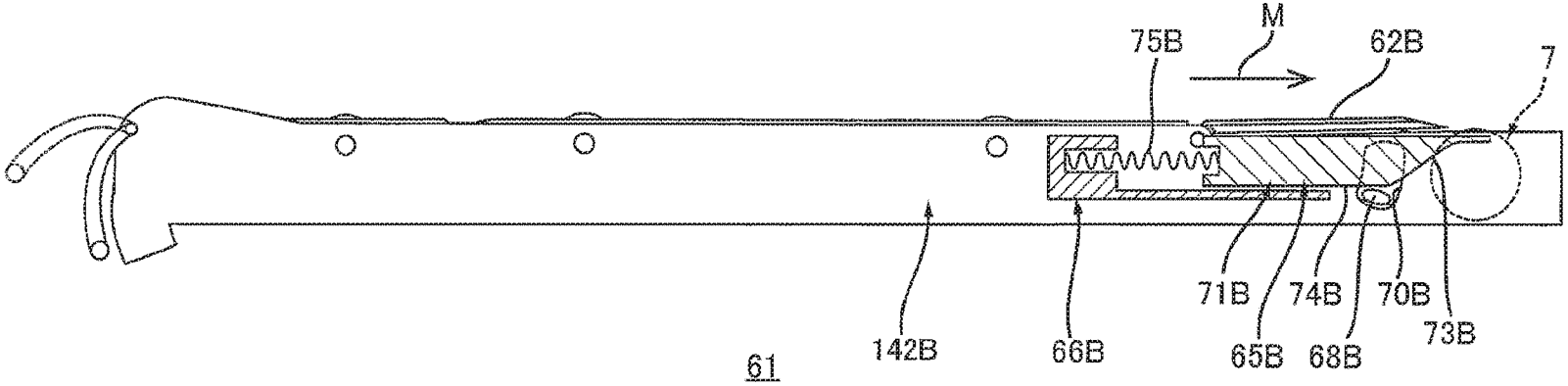
FIG. 16B is a cross-sectional view of the secondary transfer unit taken along the line E-E in FIG. 13, and illustrating a state where the second plate of the second guide member is at the second position and the secondary transfer roller is at the separation position.

When the secondary transfer unit 61 is detached from the main casing 102, the boss 68B contacts the cam 65B (see FIG. 16B). The boss 68B protrudes from the arm body 60B. The boss 68B is positioned opposite to the arm 63A with respect to the arm body 60B in the axial direction. The boss 68B is inserted through a through-hole 70B of a side plate 142B. The through-hole 70B extends in a direction in which the second plate 62B is pivotally moved.

As illustrated in FIG. 15A, the compression spring 69B urges the shaft 7B of the secondary transfer roller 7 in a direction away from the second plate 62B in the array direction. The compression spring 69B is provided at the arm 63B and is in contact with the shaft 7B of the secondary transfer roller 7.

As described above, the one end portion and the other end portion of the shaft 7B are supported by the arm 63A (see FIG. 13) and the arm 63B, respectively. As a result, the secondary transfer roller 7 is movable in accordance with pivotal movement of the second plate 62B. More specifically, the secondary transfer roller 7 is movable between a contact position (see FIG. 10) where the secondary transfer roller 7 is in contact with the intermediate transfer belt 18 and a separation position (see FIG. 17B) where the secondary transfer roller 7 is separated from the intermediate transfer belt 18. The secondary transfer roller 7 is at the contact position when the second plate 62B is at the first position, and is at the separation position when the second plate 62B is at the second position.

<6.4 Cams 65A and 65B>

As illustrated in FIGS. 11 and 13, the cam 65A is positioned opposite to the side plate 142B with respect to a side plate 142A in the axial direction. When the secondary transfer unit 61 is detached from the main casing 102, the cam 65A contacts the boss 68A. The cam 65A has a configuration the same as that of the cam 65B. In the following description, only the configuration of the cam 65B will be described while omitting the description of the cam 65A.

The cam 65B is positioned opposite to the side plate 142A with respect to the side plate 142B in the axial direction. When the secondary transfer unit 61 is detached from the main casing 102, the cam 65B contacts the boss 68B of the arm 63B. As illustrated in FIGS. 16A and 16B, the cam 65B is movable in the array direction between a pressure position (see FIG. 16B) where the cam 65B presses the boss 68B of the arm 63B and a release position (see FIG. 16A) where application of the pressing force from the cam 65B to the boss 68B is released.

The cam 65B in the release position is urged toward the pressure position by a compression spring 75B. The cam 65B is moved from the release position to the pressure position when the secondary transfer unit 61 is detached from the main casing 102. Thus, the second plate 62B is moved from the first position to the second position, and the secondary transfer roller 7 is moved from the contact position to the separation position. That is, the secondary transfer roller 7 is moved from the contact position to the separation position when the secondary transfer roller 7 is detached from the main casing 102.

On the other hand, the cam 65B is moved from the pressure position to the release position when the secondary transfer unit 61 is attached to the main casing 102. Thus, the second plate 62B is moved from the second position to the first position, and the secondary transfer roller 7 is moved from the separation position to the contact position. That is, the secondary transfer roller 7 is moved from the separation position to the contact position when the secondary transfer roller 7 is attached to the main casing 102. The cam 65B includes a cam body 71B and a boss 72B (see FIG. 11). Similarly, the boss 65A includes a cam body 71A and a boss 71A (see FIG. 13).

As illustrated in FIGS. 16A and 16B, the cam body 71B extends in the array direction. The cam body 71B has a flat plate shape, and includes a first cam surface 73B and a second cam surface 74B.

The first cam surface 73B urges the boss 68B downward during movement of the cam 65B from the release position to the pressure position. The first cam surface 73B constitutes a downstream end of the cam body 71B in a direction in which the cam 65B is moved from the release position toward the pressure position (hereinafter referred to as "moving direction M"). The first cam surface 73B is inclined upward in the moving direction M.

The second cam surface 74B is in contact with the boss 68B in a state where the cam 65B is in the pressure position. The second cam surface 74B is connected to the first cam surface 73B, and extends in the moving direction M.

Figure 17A:
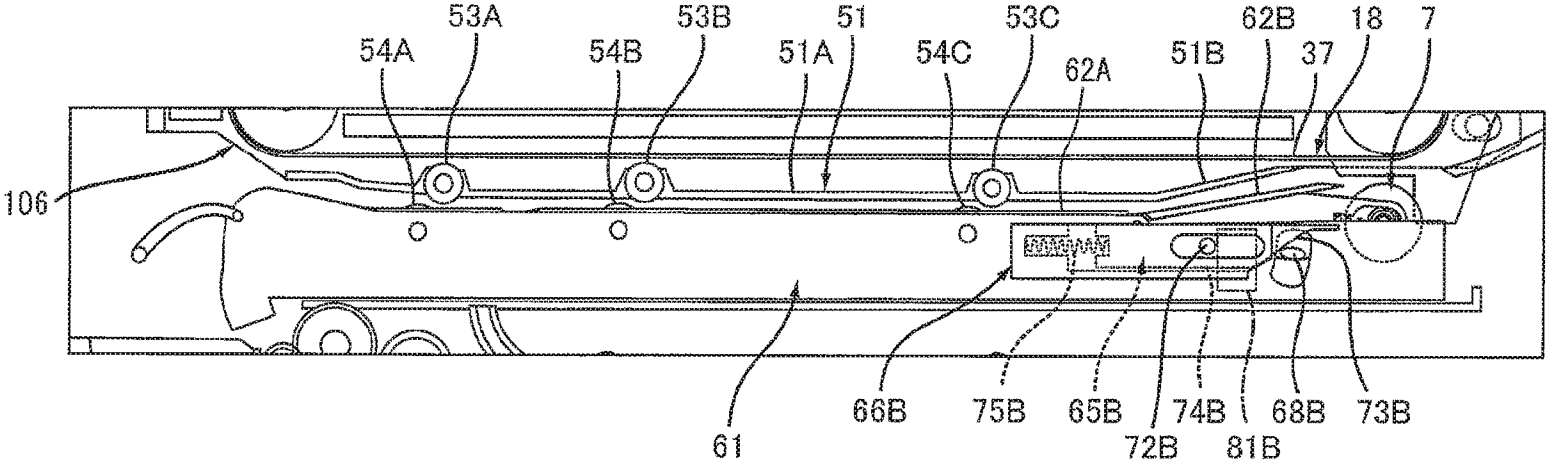
FIG. 17A is a view for description of detachment of the secondary transfer unit from a main casing of the image forming apparatus according to the second embodiment, and illustrating a state where the secondary transfer unit is moved toward a first opening of the main casing, the second plate of the second guide member is moved from the first position toward the second position, and the secondary transfer roller is moved from the contact position toward the separation position.
Figure 17B:
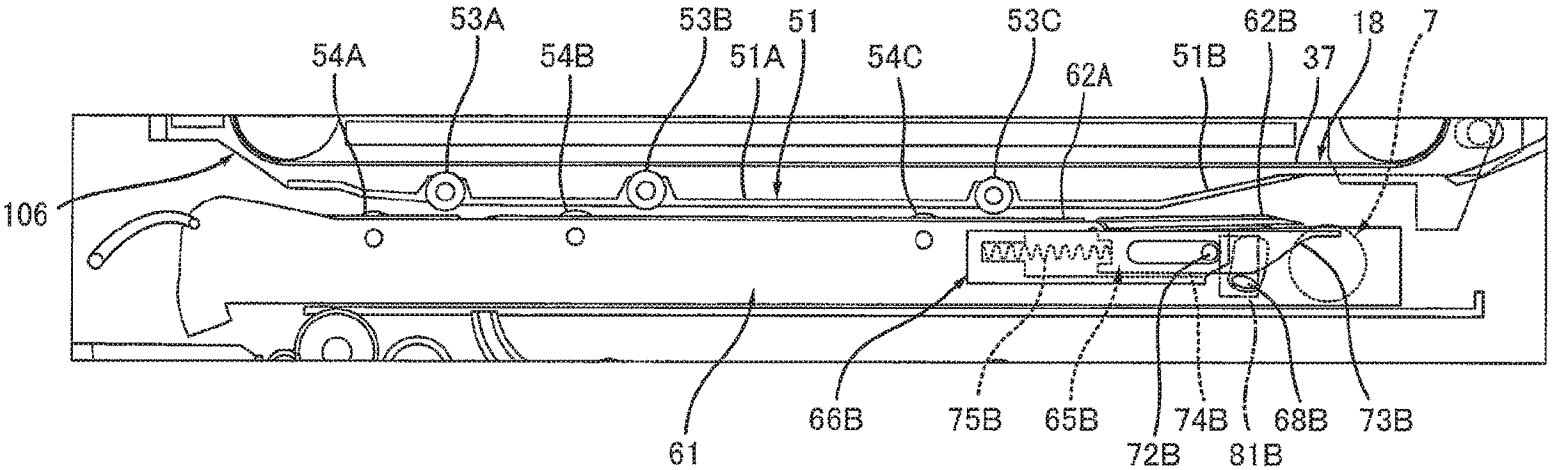
FIG. 17B is a view for description of the detachment of the secondary transfer unit from the main casing subsequent to FIG. 17A, and illustrating a state where the second plate of the second guide member is at the second position and the secondary transfer unit is at the separation position.

As illustrated in FIGS. 11 and 13, the boss 72B of the cam 65B is positioned opposite to the side plate 142B with respect to the cam body 71B in the axial direction. The boss 72B has a cylindrical shape extending in the axial direction. As illustrated in FIG. 17B, the boss 72B contacts a rib 81B provided in the main casing 102 when the secondary transfer unit 61 is attached to the main casing 102. The rib 81B is positioned downstream of the first conveying roller 53C in a direction in which the secondary transfer unit 61 is attached to the main casing 102. With this configuration, when the secondary transfer unit 61 is attached to the main casing 102, the boss 72B contacts the rib 81B while the second plate 62B is positioned downstream of the first conveying roller 53C in the direction in which the secondary transfer unit 61 is attached to the main casing 102. Accordingly, as illustrated in FIG. 17A, the cam 65B is moved toward the release position against the biasing force of the compression spring 75B when the secondary transfer unit 61 is attached to the main casing 102.

More specifically, as the boss 72B is abutted against the rib 81B during attachment process of the secondary transfer unit 41 to the main casing 102, the position of cam 65B in the main casing 102 maintains unchanged. However, since the components other than the cam 65B continues to be moved until the secondary transfer unit 41 is completely attached to the main casing 102, the cam 65B is relatively moved to the release position. Accordingly, the boss 68B is released from the pressing force applied by the second cam surface 74B of the cam 65B. At this time, the cam 65A is also relatively moved to its released position due to abutment of the boss 72A with a rib 81A provided in the main casing 102. Consequently, the arm 63A and the arm 63B are pivotally moved together with the second plate 62B, thereby moving the secondary transfer roller 7 to the contact position.

On the other hand, the cam 65B is moved back from the release position to the pressure position due to the biasing force of the compression spring 75B when the secondary transfer unit 61 is detached from the main casing 102.

<6.5 Covers 66A and 66B>

Figure 12:
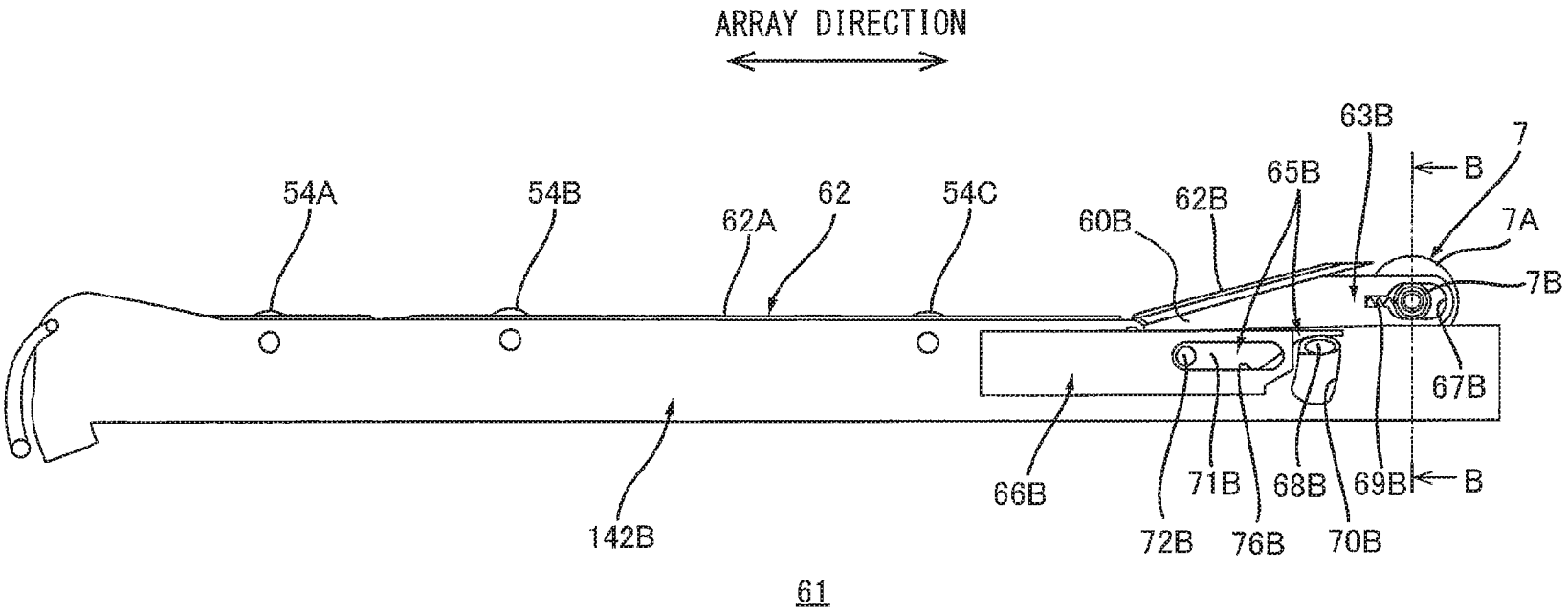
FIG. 12 is a side view of the secondary transfer unit illustrated in FIG. 11.

As illustrated in FIGS. 11 and 12, the cover 66A covers the cam 65A, and the cover 66B covers the cam 65B. The cover 66A is fixed to the side plate 142B. The cover 66A has a configuration the same as that of the cover 66B. Therefore, only the cover 66B will be described while description as to the cover 66A is omitted.

The cover 66B is positioned opposite to the side plate 142B with respect to the cam body 71B of the cam 65B in the axial direction. The cover 66B is formed with a through-hole 76B through which the boss 72B of the cam 65B is inserted. The through-hole 76B is an elongated slot extending in the array direction.

<6.6 Operational Advantages in the Second Embodiment>

In the image forming apparatus 101 according to the second embodiment, as illustrated in FIGS. 17A and 17B, the second plate 62B is moved from the first position to the second position, and the secondary transfer roller 7 is moved from the contact position to the separation position when the secondary transfer unit 61 is detached from the main casing 102.

Hence, as illustrated in FIG. 10, the second guide member 62 can be detached from the main casing 102 together with the secondary transfer roller 7 through the first opening 2A.

Further, the configuration according to the second embodiment can obtain the same operational advantages described in the first embodiment.

While the description has been made in detail with reference to the embodiments thereof, it would be apparent to those skilled in the art that many modifications and variations may be made therein without departing from the spirit of the disclosure.

What is claimed is:

1. An image forming apparatus comprising:

a main casing having a front opening on a front wall and a rear opening on a rear wall opposite to the front wall;

a sheet cassette for supporting a sheet;

a sheet supply unit for supplying the sheet, the sheet supply unit being disposed closer to the front wall than to the rear wall;

a fixing unit for fixing toner image onto the sheet, the fixing unit being disposed closer to the rear wall than to the front wall;

a drum unit including a photosensitive drum, the drum unit being disposed between the sheet supply unit and the fixing unit;

a belt unit comprising:

a first roller;

a second roller spaced apart from the first roller;

an intermediate transfer belt supported by the first roller and the second roller; and a primary transfer member disposed between the first roller and the second roller, the primary transfer member being configured to transfer toner image from the photosensitive drum to the intermediate transfer belt, the belt unit being disposed between the drum unit and the sheet cassette, the first roller being disposed closer to the fixing unit than to the sheet supply unit;

a secondary transfer member configured to transfer the toner image from the intermediate transfer belt to the sheet, the secondary transfer member being disposed between the belt unit and the sheet cassette, the secondary transfer member being disposed closer to the first roller than to the second roller; and a sheet guide configured to guide the sheet from the sheet supply unit toward the secondary transfer member, the sheet guide comprising a first guide member and a second guide member, the first guide member being disposed between the second guide member and the belt unit, the second guide member being disposed between the first guide member and the sheet cassette, wherein the second guide member is attachable to and detachable from the main casing through the rear opening.

2. The image forming apparatus according to claim 1, wherein the first guide member is attachable to and detachable from the main casing together with the belt unit through the front opening.

3. The image forming apparatus according to claim 1, wherein the primary transfer member is a primary transfer roller.

4. The image forming apparatus according to claim 1, wherein the secondary transfer member is a secondary transfer roller.

5. An image forming apparatus comprising:

a main casing having a front opening on a front wall and a rear opening on a rear wall opposite to the front wall;

a sheet cassette for supporting a sheet;

a sheet supply unit for supplying the sheet, the sheet supply unit being disposed closer to the front wall than to the rear wall;

a fixing unit for fixing toner image onto the sheet, the fixing unit being disposed closer to the rear wall than to the front wall;

a drum unit including a photosensitive drum, the drum unit being disposed between the sheet supply unit and the fixing unit;

a belt unit comprising:

a first roller;

a second roller spaced apart from the first roller;

an intermediate transfer belt supported by the first roller and the second roller; and a primary transfer member disposed between the first roller and the second roller, the primary transfer member being configured to transfer toner image from the photosensitive drum to the intermediate transfer belt, the belt unit being disposed between the drum unit and the sheet cassette, the first roller being disposed closer to the fixing unit than to the sheet supply unit; and a sheet guide configured to guide the sheet from the sheet supply unit toward the intermediate transfer belt, the sheet guide comprising a first guide member and a second guide member, the first guide member being disposed between the second guide member and the belt unit, the second guide member comprising a secondary transfer member configured to transfer the toner image from the intermediate transfer belt to the sheet, wherein the second guide member is attachable to and detachable from the main casing together with the secondary transfer member through the rear opening.

6. The image forming apparatus according to claim 5, wherein the first guide member is attachable to and detachable from the main casing together with the belt unit through the front opening.

7. The image forming apparatus according to claim 5, wherein the primary transfer member is a primary transfer roller.

8. The image forming apparatus according to claim 5, wherein the secondary transfer member is a secondary transfer roller.

9. An image forming apparatus comprising:

a main casing having a front opening on a front wall and a rear opening on a rear wall opposite to the front wall;

a sheet cassette for supporting a sheet;

a sheet supply unit for supplying the sheet, the sheet supply unit being disposed closer to the front wall than to the rear wall;

a fixing unit for fixing toner image onto the sheet, the fixing unit being disposed closer to the rear wall than to the front wall;

a drum unit including a photosensitive drum, the drum unit being disposed between the sheet supply unit and the fixing unit;

a belt unit comprising:

a first roller;

a second roller spaced apart from the first roller;

an intermediate transfer belt supported by the first roller and the second roller; and a primary transfer member disposed between the first roller and the second roller, the primary transfer member being configured to transfer toner image from the photosensitive drum to the intermediate transfer belt, the belt unit being disposed between the drum unit and the sheet cassette, the first roller being disposed closer to the fixing unit than to the sheet supply unit;

a secondary transfer member configured to transfer the toner image from the intermediate transfer belt to the sheet, the secondary transfer member being disposed between the belt unit and the sheet cassette, the secondary transfer member being disposed closer to the first roller than to the second roller; and a sheet guide configured to guide the sheet from the sheet supply unit toward the secondary transfer member, the sheet guide comprising a first guide member and a second guide member, the first guide member being disposed between the second guide member and the belt unit, the second guide member being disposed between the first guide member and the sheet cassette, wherein the second guide member is attachable to and detachable from the main casing through the front opening.

10. An image forming apparatus comprising:

a main casing having a front opening on a front wall and a rear opening on a rear wall opposite to the front wall;

a sheet cassette for supporting a sheet;

a sheet supply unit for supplying the sheet, the sheet supply unit being disposed closer to the front wall than to the rear wall;

a fixing unit for fixing toner image onto the sheet, the fixing unit being disposed closer to the rear wall than to the front wall;

a drum unit including a photosensitive drum, the drum unit being disposed between the sheet supply unit and the fixing unit;

a belt unit comprising:

a first roller;

a second roller spaced apart from the first roller;

an intermediate transfer belt supported by the first roller and the second roller; and a primary transfer member disposed between the first roller and the second roller, the primary transfer member being configured to transfer toner image from the photosensitive drum to the intermediate transfer belt, the belt unit being disposed between the drum unit and the sheet cassette, the first roller being disposed closer to the fixing unit than to the sheet supply unit; and a sheet guide configured to guide the sheet from the sheet supply unit toward the intermediate transfer belt, the sheet guide comprising a first guide member and a second guide member, the first guide member being disposed between the second guide member and the belt unit, the second guide member comprising a secondary transfer member configured to transfer the toner image from the intermediate transfer belt to the sheet, wherein the second guide member is attachable to and detachable from the main casing together with the secondary transfer member through the front opening.

* * * * *